US008428293B2

(12) United States Patent
Fujise et al.

(10) Patent No.: US 8,428,293 B2
(45) Date of Patent: Apr. 23, 2013

(54) SPEAKER DEVICE

(75) Inventors: Akiko Fujise, Osaka (JP); Hiroyuki Takewa, Osaka (JP); Mikio Iwasa, Osaka (JP)

(73) Assignee: Panasonic Corporation, Osaka (JP)

( * ) Notice: Subject to any disclaimer, the term of this patent is extended or adjusted under 35 U.S.C. 154(b) by 701 days.

(21) Appl. No.: 12/600,858

(22) PCT Filed: May 20, 2008

(86) PCT No.: PCT/JP2008/001259

§ 371 (c)(1),
(2), (4) Date: Nov. 19, 2009

(87) PCT Pub. No.: WO2008/142867

PCT Pub. Date: Nov. 27, 2008

(65) Prior Publication Data

US 2010/0158282 A1 Jun. 24, 2010

(30) Foreign Application Priority Data

May 21, 2007 (JP) ..... 2007-133709

(51) Int. Cl.
*H04R 1/00* (2006.01)

(52) U.S. Cl.
USPC ..... 381/398; 381/160; 381/182

(58) Field of Classification Search ..... 381/182, 381/160, 398
See application file for complete search history.

(56) References Cited

U.S. PATENT DOCUMENTS

| | | | | |
|---|---|---|---|---|
| 7,031,487 | B2 * | 4/2006 | Stiles | 381/398 |
| 7,684,574 | B2 * | 3/2010 | Keele et al. | 381/160 |
| 2003/0053648 | A1 | 3/2003 | Jorgensen et al. | |
| 2005/0041530 | A1 | 2/2005 | Goudie et al. | |
| 2005/0194959 | A1 | 9/2005 | Miller | |
| 2006/0269070 | A1 | 11/2006 | Miura et al. | |

FOREIGN PATENT DOCUMENTS

| | | |
|---|---|---|
| JP | 2-113493 | 9/1990 |
| JP | 6-225379 | 8/1994 |
| JP | 09-233591 | 9/1997 |
| JP | 2003-125482 | 4/2003 |
| JP | 2004-320100 | 11/2004 |

(Continued)

OTHER PUBLICATIONS

International Search Report issued Aug. 26, 2008 in International (PCT) Application No. PCT/JP2008/001259.

(Continued)

*Primary Examiner* — Davetta W Goins
*Assistant Examiner* — Amir Etesam
(74) *Attorney, Agent, or Firm* — Wenderoth, Lind & Ponack, L.L.P.

(57) ABSTRACT

A speaker device includes a plurality of speaker units arranged in a line when seen from the front side of the speaker device. At least one of intervals between effective vibration regions of adjacent speaker units is set to a predetermined length. The predetermined length is a length that is set such that a difference between a distance from an end of one of the effective vibration regions, which form the at least one of intervals therebetween, to a listening position, and a distance from an end of the other of the effective vibration regions to the listening position can be less than half the shortest wavelength of a reproduced sound of each of the speaker units.

17 Claims, 24 Drawing Sheets

FOREIGN PATENT DOCUMENTS

| | | |
|---|---|---|
| JP | 2005-506780 | 3/2005 |
| JP | 2005-249771 | 9/2005 |
| JP | 2006-191285 | 7/2006 |
| JP | 2006-303658 | 11/2006 |
| JP | 2006-319390 | 11/2006 |
| JP | 2007-28085 | 2/2007 |
| JP | 2007-74336 | 3/2007 |
| WO | 91/19408 | 12/1991 |
| WO | 2006/096801 | 9/2006 |
| WO | 2007/007446 | 1/2007 |

OTHER PUBLICATIONS

Supplementary European Search Report issued Feb. 23, 2012 in corresponding European Patent Application No. 08751777.7.

Japanese Office Action issued Aug. 1, 2012 in corresponding Japanese Patent Application No. 2009-515095 with partial English translation.

* cited by examiner

SPEAKER DEVICE

TECHNICAL FIELD

The present invention relates to a speaker device, and more particularly to a speaker device having a plurality of speaker units arranged in a line, such as a line-array speaker.

BACKGROUND ART

Conventionally, a speaker device having a plurality of speaker units arranged in a line, such as a line-array speaker, is generally known (for example, see Patent Document 1). FIG. 25 is a diagram showing a structure of a speaker device which is a line-array speaker. In FIG. 25, (a) shows a front view of the speaker device, and (b) is a side view of the speaker device showing a cross sectional structure thereof.

A speaker device 9 includes a cabinet 91 and a plurality of speaker units 92. Each of the plurality of speaker units 92 is mounted in the cabinet 91 such that the front surface of the speaker unit 92 faces the front side of the cabinet 91. As shown in (a) of FIG. 25, the speaker units 92 are arranged in a straight line, when seen from the front side of the speaker device 9, and the arrangement direction is parallel to the up-and-down direction of the speaker device 9. In addition, as shown in (b) of FIG. 25, the speaker units 92 are arranged in a straight line, when seen from a lateral side of the speaker device 9. Each speaker unit 92 has the same structure section as that of an ordinary electrodynamic speaker. In (b) of FIG. 25, the structure section of each speaker unit 92 is schematically shown.

Due to such a structure, a line source is approximately formed in the arrangement direction of the speaker units 92. Therefore, when the speaker device 9 is used at home or the like where a listening position is at a short distance, a sound field is, at the listening position, uniform in the arrangement direction of the speaker units 92, while the sound field is non-directional in the direction perpendicular to the arrangement direction. That is, a listening area can be increased, as compared with when a speaker device having one speaker unit is used.

Patent Document 1: Japanese Laid-Open Patent Publication No. 2004-320100

SUMMARY OF THE INVENTION

Problems to be Solved by the Invention

However, there is a problem that, in the speaker device 9, a phase interference among the plurality of speaker units 92 causes a peak/dip in the sound pressure/frequency characteristics of a reproduced sound at the listening position, which deteriorates the sound quality in a high range.

Hereinafter, a deterioration of sound quality due to the phase interference will be specifically described with reference to FIGS. 26 and 27. FIG. 26 is a diagram showing a difference, in acoustic wave propagation, between a line source and a point sound source array. In FIG. 26, (a) shows acoustic wave propagation from the line source, and (b) shows acoustic wave propagation from the point sound source array. In (a) and (b) of FIG. 26, the solid lines and the dotted lines, which are arranged side by side in the direction indicated by the arrow, indicate acoustic waves of mutually opposite phases, respectively. FIG. 27 is a diagram showing sound pressure/frequency characteristics (calculated values) of reproduced sounds, at a certain listening position, of a line source having a length of 1.5 [m] and of a point sound source array (the number of point sound sources N=16) having an arrangement length of 1.5 [m].

When the speaker device 9 produces, over the entire reproduction frequency band, an ideal line source as shown in (a) of FIG. 26, the sound pressure/frequency characteristics at the listening position have attenuation characteristics of −6 dB/octave in a high range, and moreover see moderate changes between peaks and troughs, as illustrated with the solid line in FIG. 27. However, the line source produced by the speaker device 9 is merely approximate, and actually is a plurality of sound sources, which are similar to point sound sources, being arranged at intervals, as shown in (b) of FIG. 26. Due to the intervals, the phase interference significantly occurs around a particular frequency. Specifically, as illustrated with the dotted line in FIG. 27, in the sound pressure/frequency characteristics at the listening position, a sudden drop in sound pressure (dip) occurs in a high frequency range, and changes between peaks and troughs are sharp.

Against such a deterioration of sound quality, which is caused by a phase interference, a method of resolving a peak/dip by, for example, correcting the frequency characteristics of an acoustic signal using an equalizer has conventionally been proposed. However, a frequency at which a peak/dip occurs is largely changed by a slight variation in listening position. Therefore, it is difficult to resolve the peak/dip, and the deterioration of sound quality due to the phase interference cannot be suppressed.

Therefore, an object of the present invention is to provide a speaker device which has a plurality of speaker units arranged in a line and is capable of, when used at home or the like where a listening position is at a short distance, suppressing a deterioration of sound quality due to a phase interference.

Solution to the Problems

The present invention has been accomplished to solve the above-described problem, and a speaker device according to the present invention is a speaker device including a plurality of speaker units arranged in a line when seen from the front side of the speaker device. At least one of intervals between effective vibration regions of adjacent speaker units is set to a predetermined length. The predetermined length is a length that is set such that a difference between a distance from an end of one of the effective vibration regions, which form the at least one of intervals therebetween, to a listening position, and a distance from an end of the other of the effective vibration regions to the listening position can be less than half the shortest wavelength of a reproduced sound of each of the speaker units.

In such a configuration, when the speaker device is used at home or the like where the listening position is at a short distance, sounds reproduced by at least two speaker units, the interval between which is set to the predetermined length, can be prevented from causing a phase interference. Therefore, a deterioration of sound quality due to the phase interference can be suppressed more than ever before.

Preferably, each of the speaker units includes a diaphragm and an surround provided at an outer circumference of the diaphragm; and two of the speaker units, an interval between which is set to the predetermined length, are arranged such that the surrounds of the two speaker units partly overlap each other within the interval.

Preferably, the speaker units are arranged in an arc when seen from a lateral side of the speaker device. In such a case, furthermore, it may be preferable that a relationship of $(R+D)\times(L/R)\geqq D$ is satisfied, where: an arrangement length of the speaker units is defined as L; the curvature radius of the arc is defined as R; and a listening distance from the center of the arrangement of the speaker units to the listening position is defined as D. Alternatively, it may be preferable that, when a listening distance from the center of the arrangement of the speaker units to the listening position is equal to or less than 5 m, a relationship of $(L/R) \geqq 1.5$ is satisfied, where: an arrangement length of the speaker units is defined as L; and the curvature radius of the arc is defined as R. Alternatively, it may be preferable that, when a listening distance from the center of the arrangement of the speaker units to the listening position is 3 m, a relationship of $(L/R) \geqq 0.5$ is satisfied, where: an arrangement length of the speaker units is defined as L; and the curvature radius of the arc is defined as R.

Preferably, the speaker units are arranged in a straight line when seen from a lateral side of the speaker device. In such a case, furthermore, it may be preferable that: the speaker device further includes delay means for delaying an inputted acoustic signal by a delay time which is set so as to correspond to each of the speaker units, and outputting the delayed acoustic signal to the corresponding speaker unit; and the delay time is set to a time period in which the reproduced sound propagates from a position at which a corresponding speaker unit is arranged to a position at which the corresponding speaker unit is supposed to be arranged, assuming that the speaker units are arranged in an arc when seen from a lateral side of the speaker device. Furthermore, it may be preferable that each of the speaker units is inclined relative to an arrangement direction which is along a straight line when seen from a lateral side of the speaker device, at an angle corresponding to a position at which each speaker unit is supposed to be arranged, assuming that the speaker units are arranged in an arc when seen from a lateral side of the speaker device.

Preferably, the speaker device further includes a cabinet in which the speaker units are mounted.

Preferably, the speaker device further includes one frame to which the speaker units are mounted, and each of the speaker units includes a diaphragm and an surround which is provided at an outer circumference of the diaphragm and supports the diaphragm on the frame such that the diaphragm is vibratable. In such a case, furthermore, it may be preferable that two of the speaker units, an interval between which is set to the predetermined length, are mounted to the frame such that the surrounds of the two speaker units partly overlap each other within the interval.

Preferably, each of the speaker units includes a diaphragm, and the speaker device further includes: one frame to which the speaker units are mounted; and one surround which surrounds an outer circumference of each diaphragm, and supports the diaphragm on the frame such that the diaphragm is vibratable.

Preferably, an effective vibration region of each of the speaker units may have an area of $4\pi$ [$cm^2$] or larger. Moreover, a drive system of each of the speaker units may be of any one of an electrodynamic type, a piezoelectric type, an electrostatic type, and an electromagnetic type. Furthermore, each of the speaker units may include a diaphragm having any one of a circular shape, an oval shape, and a rectangular shape.

The present invention is also directed to a video apparatus, and a video apparatus according to the present invention includes the above-described speaker device and a housing having the speaker device disposed therein.

Effect of the Invention

According to the present invention, a speaker device can be provided which has a plurality of speaker units arranged in a line and is capable of, when used at home or the like where a listening position is at a short distance, suppressing a deterioration of sound quality due to a phase interference.

BRIEF DESCRIPTION OF THE DRAWINGS

FIG. 10 is a diagram showing sound pressure/frequency characteristics exhibited when an interval d is changed while the arrangement length L is kept constant.

FIG. 17 is a diagram showing a structure of a speaker device according to Embodiment 4.

FIG. 18 is a diagram showing a structure of a speaker module 42.

FIG. 23 is a diagram showing a structure of a speaker device 63.

FIG. 24 is a diagram showing another structure of the speaker device 63.

FIG. 26 is a diagram showing a difference, in acoustic wave propagation, between a line source and a point sound source array.

FIG. 27 is a diagram showing sound pressure/frequency characteristics (calculated values) of reproduced sounds, at a certain listening position, of a line source having a length of 1.5 [m] and of a point sound source array (the number of point sound sources N=16) having an arrangement length of 1.5 [m].

DESCRIPTION OF THE REFERENCE CHARACTERS

Figure 1:
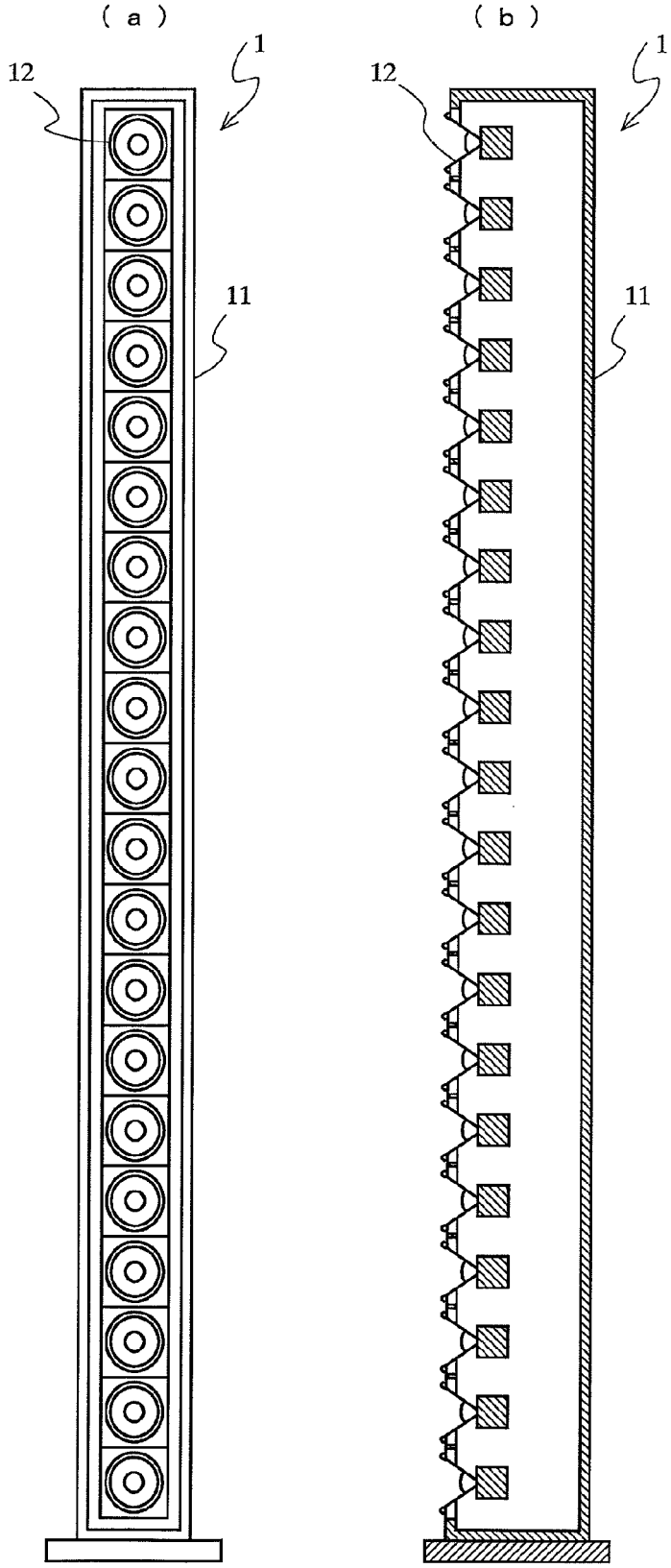
FIG. 1 is a diagram showing a structure of a speaker device according to Embodiment 1.

1, 2, 3, 4, 5, 63, 9 speaker device
11, 21, 31, 41, 51, 91 cabinet
12, 12*a*, 32, 32*a*, 52-1 to 52-20, 632, 632*a*, 92 speaker unit
121, 221, 421, 631 frame
122, 322, 6323*a-d* surround
123, 323 diaphragm
124, 324 voice coil bobbin
125, 325 voice coil
126, 326 yoke
127, 327 magnet
128, 328 plate
1221, 3221 round portion
1222, 3222 adhesion margin
22, 42 speaker module
2211, 4211 front-face plate
2212, 4212 support member
2213, 4213 coupling member
53 delay means
53-1 to 53-9 delay device
6 flat-screen television
61 housing
62 display
631*a* suspension portion
6321 substrate
6322 piezoelectric element

BEST MODE FOR CARRYING OUT THE INVENTION

Hereinafter, embodiments of the present invention will be described with reference to the drawings.

Embodiment 1

FIG. 1 is a diagram showing a structure of a speaker device according to Embodiment 1 of the present invention. In FIG. 1, (a) shows a front view of the speaker device, and (b) is a side view of the speaker device showing a cross-sectional structure thereof.

A speaker device 1 includes a cabinet 11 and a plurality of speaker units 12, and is placed at home or the like where a listening position is at a short distance. In an example shown in FIG. 1, the speaker device 1 includes twenty speaker units 12, but this is not limitative. Each speaker unit 12 is an electrodynamic speaker, and mounted in the cabinet 11 such that the front surface of the speaker unit 12 faces the front side of the cabinet 11. As shown in (a) of FIG. 1, the speaker units 12 are arranged in a straight line, when seen from the front side of the speaker device 1, and the arrangement direction is parallel to the up-and-down direction of the speaker device 1. In addition, as shown in (b) of FIG. 1, the speaker units 12 are arranged in a straight line, when seen from the lateral side of the speaker device 1. Each speaker unit 12 has the same structure section as that of an ordinary electrodynamic speaker. In (b) of FIG. 1, the structure section of each speaker unit 12 is schematically shown.

An operation of the speaker device 1 having the above-described structure will be described. An acoustic signal, which is outputted from an audio amplifier, not shown, is inputted to each of the plurality of speaker units 12 via a cable, not shown. Here, acoustic signals inputted to the plurality of speaker units 12, respectively, have the same level. The acoustic signal is converted into a mechanical vibration by each speaker unit 12, and emitted into the air, as a reproduced sound, from a diaphragm which is provided on the front surface of the speaker unit 12. As the acoustic signal, a monaural audio signal, a stereo audio signal, a multi-channel audio signal, and the like, may be mentioned.

Hereinafter, a manner of arrangement of the speaker unit 12 according to the present embodiment will be described.

In an ideal line source, a sound source is linear, and therefore the phase of an acoustic wave, which arrives at a listening position from an arbitrary point on the sound source, continuously changes in accordance with the position of the arbitrary point. Therefore, as shown in FIG. 27, the sound pressure/frequency characteristics of the reproduced sound at the listening position see moderate changes between peaks and troughs in a high frequency range. On the other hand, in a case where a plurality of sound sources which are similar to point sound sources are arranged at intervals, the phase of an acoustic wave, which arrives at the listening position from the sound source, discontinuously changes in accordance with the position of the sound source, due to the intervals. Therefore, as shown in FIG. 27, the sound pressure/frequency characteristics of the reproduced sound at the listening position see sharp changes between peaks and troughs in a high frequency range. Particularly in such a frequency band that a difference (hereinafter referred to as a differential distance Q), between a distance from one end of the interval of adjacent sound sources to the listening position and a distance from the other end of the interval to the listening position, is equal to or larger than half the wavelength of the reproduced sound, sounds of opposite phases cancel each other so that sound pressure is considerably lowered and a peak/dip is caused.

In the present embodiment, therefore, a plurality of sound sources, namely, a plurality of speaker units 12, are arranged in such a manner that the differential distance Q is less than half the wavelength of the reproduced sound at the upper limit frequency of the reproduction band of the speaker unit 12. As a result, the sound source produced by the speaker device 1 can be closer to an ideal line source, and a peak/dip due to a phase interference can be prevented from occurring in the reproduction band. That is, a deterioration of sound quality due to the phase interference can be prevented. In the following, a specific description of the differential distance Q will be given.

Figure 2:
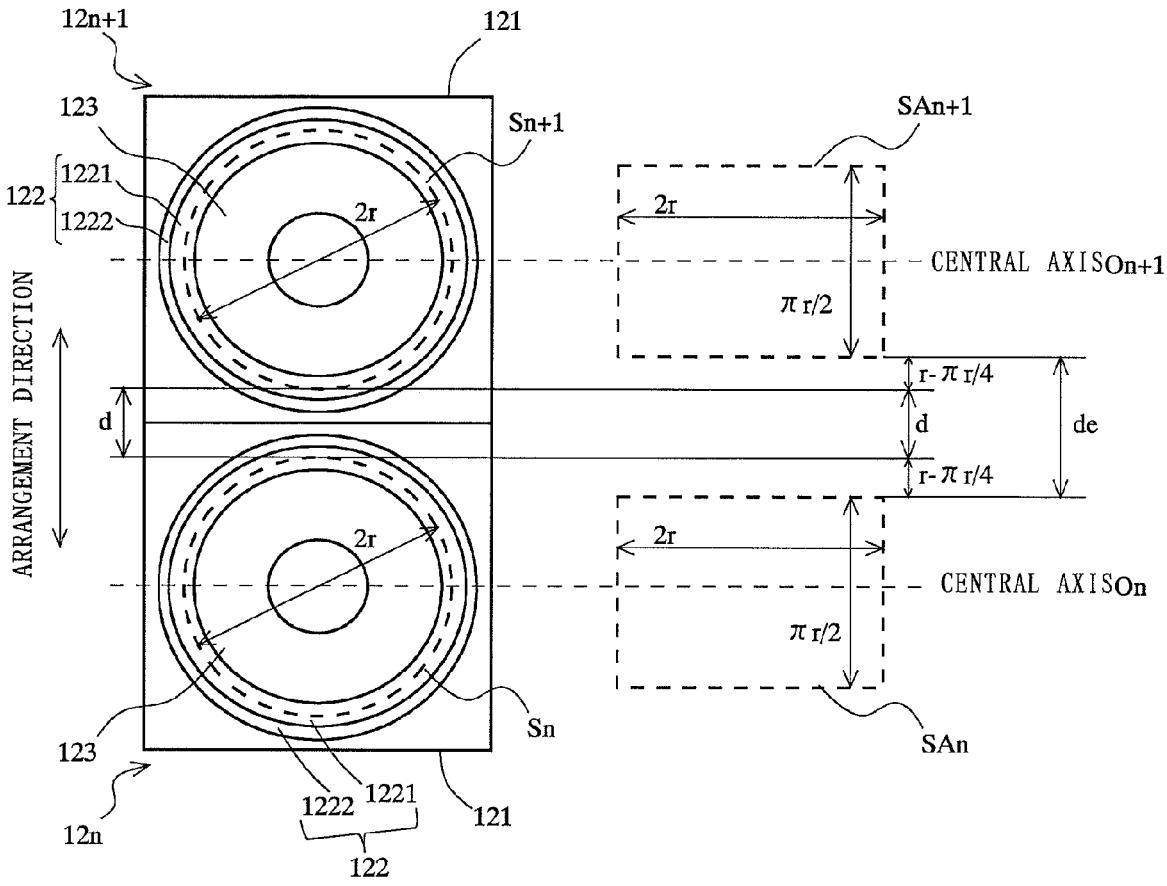
FIG. 2 is a schematic diagram showing effective vibration regions of speaker units 12, and an interval between the effective vibration regions.

A condition for the differential distance Q is obtained by use of an interval between effective vibration regions of the speaker units 12. The interval between the effective vibration regions of the speaker units 12 will be specifically described with reference to FIG. 2. FIG. 2 is a schematic diagram showing effective vibration regions of speaker units 12, and an interval between the effective vibration regions. FIG. 2 shows two speaker units 12, and the upper speaker unit is denoted by the reference numeral $\mathbf{12}_{n+1}$ while the lower speaker unit is denoted by the reference numeral $\mathbf{12}_{n}$, for the convenience of the description. Each of the speaker units $\mathbf{12}_{n}$ and $\mathbf{12}_{n+1}$ includes a frame 121, a surround 122, and a diaphragm 123. In addition, each of the speaker units $\mathbf{12}_{n}$ and $\mathbf{12}_{n+1}$ includes a voice coil and a magnetic circuit, although not shown in FIG. 2. The surround 122 includes a round portion 1221 and an adhesion margin 1222. The adhesion margin 1222 is adhered to the frame 121, and an inner circumference of the round portion 1221 is adhered to an outer circumference of the diaphragm 123. A circle $S_n$, which is illustrated with a dotted line on the speaker unit $\mathbf{12}_{n}$, indicates a vibration region in which the speaker unit $\mathbf{12}_n$ actually vibrates. A circle $S_{n+1}$, which is illustrated with a dotted line on the speaker unit $\mathbf{12}_{n+1}$, indicates a vibration region in which the speaker unit $\mathbf{12}_{n+1}$ actually vibrates. In FIG. 2, effective radii of both of the vibration regions $S_n$ and $S_{n+1}$ are defined as r, and an interval between the upper end of the vibration region $S_n$ and the lower end of the vibration region $S_{n+1}$ is defined as d.

An effective vibration region $SA_n$ is a region: of which the central axis $O_n$, extending in the direction perpendicular to the arrangement direction, is coincident with that of the vibration region $S_n$; of which the size with respect to the central axis $O_n$ direction is "2r", which is the same as that of the vibration region $S_n$; and of which the size with respect to the arrangement direction is "πr/2" such that the region have the same area as that of the vibration region $S_n$. Similarly, an effective vibration region $SA_{n+1}$ is a region: of which the central axis $O_{n+1}$, extending in the direction perpendicular to the arrangement direction, is coincident with that of the vibration region $S_{n+1}$; of which the size with respect to the central axis $O_{n+1}$ direction is "2r", which is the same as that of the vibration region $S_{n+1}$; and of which the size with respect to the arrangement direction is "πr/2" such that the region have the same area as that of the vibration region $S_{n+1}$. In an example shown in FIG. 2, since the vibration regions $S_n$ and $S_{n+1}$ have circular shapes, a distance between the vibration regions is the distance d at the minimum, and becomes larger at a position farther from the central axis of the vibration region, which extends in parallel to the arrangement direction, For considering the influence thereof, defined are the effective vibration regions $SA_n$ and $SA_{n+1}$ which are formed such that the distance between the vibration regions can be constant with respect to the direction perpendicular to the arrangement direction, as described above. If the vibration region has a rectangular shape, the effective vibration region is exactly the vibration region.

An interval de between the effective vibration regions $SA_n$ and $SA_{n+1}$ is represented by the formula (1).

[Formula 1]

$$\begin{aligned} de &= (r - \pi r/4) + d + (r - \pi r/4) \\ &= d + r(2 - \pi/2) \end{aligned} \tag{1}$$

Figure 3:
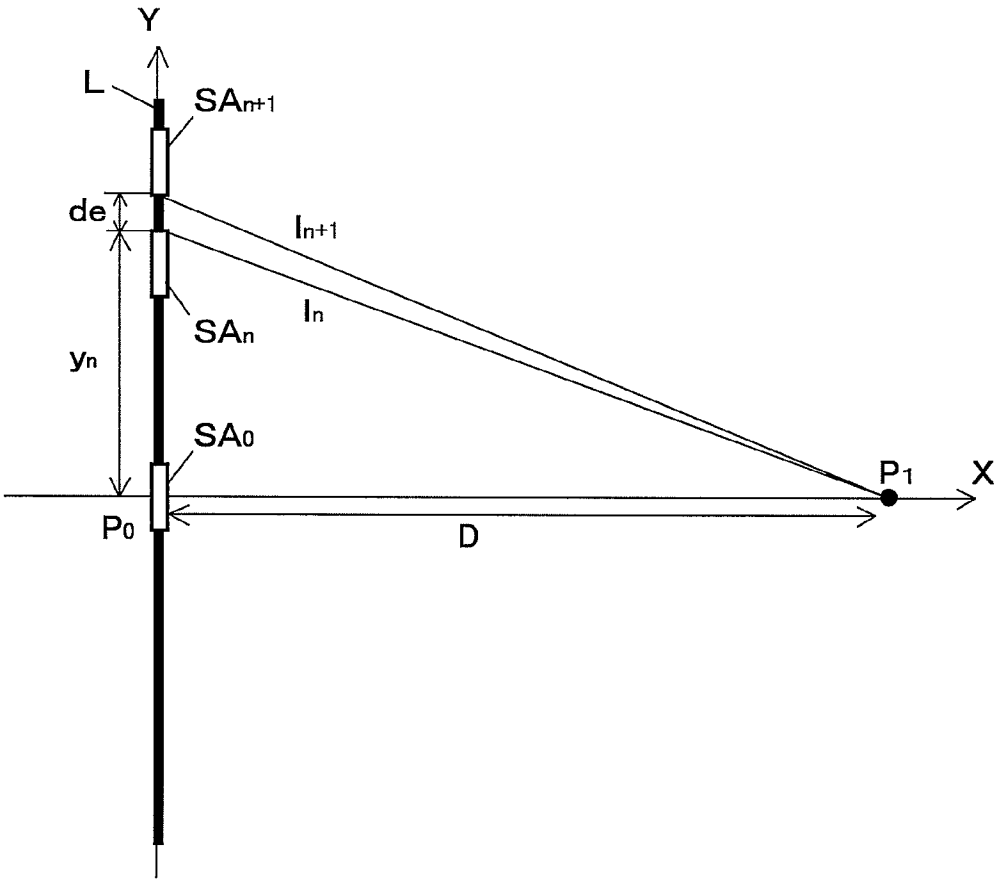
FIG. 3 is a diagram for illustrating a condition for a differential distance Q according to Embodiment 1.

Next, the condition for the differential distance Q will be specifically described with reference to FIG. 3. FIG. 3 is a diagram for illustrating a condition for the differential distance Q. In FIG. 3, the front surface of the cabinet 11 is on the Y-axis, and the arrangement length (the length of the straight line) of the speaker unit 12 is defined as L. A listening position $P_1$ is located on the X-axis that passes through the center $P_0$ of the arrangement of the speaker units 12. A listening distance between the listening position $P_1$ and the center $P_0$ is defined as D. The effective vibration region of the speaker unit 12 arranged at the center $P_0$ is defined as $SA_0$. The n-th effective vibration region counted from the effective vibration region $SA_0$ toward the Y-axis positive direction is defined as $SA_n$, and the n+1-th effective vibration region is defined as $SA_{n+1}$. A distance from the upper end of the effective vibration region $SA_n$ to the center $P_0$ is defined as $y_n$. An interval between the upper end of the effective vibration region $SA_n$ and the lower end of the effective vibration region $SA_{n+1}$ is the interval de which is shown in FIG. 2. At this time, the differential distance Q is represented by a difference between a distance $l_n$ and a distance $l_{n+1}$. The distance $l_n$ is from the upper end of the effective vibration region $SA_n$ to the listening position $P_1$. The distance $l_{n+1}$ is from the lower end of the effective vibration region $SA_{n+1}$ to the listening position $P_1$. The upper end of the effective vibration region $SA_n$ and the lower end of the effective vibration region $SA_{n+1}$ form the interval de. This difference has to be less than half the wavelength of the reproduced sound at the upper limit frequency of the reproduction band of the speaker unit 12. When the wavelength of the reproduced sound at the upper limit frequency of the reproduction band of the speaker unit 12 is defined as λ, the specific condition for the differential distance Q is represented by the formula (2).

[Formula 2]

$$Q = l_{n+1} - l_n = \sqrt{D^2 + (y_n + de)^2} - \sqrt{D^2 + y_n^2} < \frac{\lambda}{2} \tag{2}$$

As described above, in the present embodiment, a plurality of speaker units 12 are arranged such that the differential distance Q is less than half the wavelength of the reproduced sound at the upper limit frequency of the reproduction band of the speaker unit 12. As a result, the sound source produced by the speaker device 1 can be closer to an ideal line source, and a peak/dip due to a phase interference can be prevented from occurring in the reproduction band. That is, a deterioration of sound quality due to the phase interference can be prevented.

Moreover, in the present embodiment, since the speaker device 1 is placed at home or the like where a listening position is at a short distance, a listening area can be increased, as compared with when a speaker device having one speaker unit is placed.

In the above description, all of the plurality of speaker units 12 are arranged based on the interval de that is obtained when the differential distance Q satisfies the formula (2). However, this is not limitative. As long as at least two speaker units 12 are arranged based on the interval de that is obtained when the differential distance Q satisfies the formula (2), a deterioration of sound quality due to a phase interference can be suppressed more than ever before, but only under the condition that an interval between the speaker units 12 other than the at least two speaker units 12 is less than ever before.

Moreover, in the above description, acoustic signals inputted to the plurality of speaker units 12 have the same level. However, acoustic signals having different levels may be inputted to the respective speaker units 12.

Furthermore, in the above description, a front shape of the diaphragm 123 of the speaker unit 12 is a circular shape, but the front shape of the diaphragm 123 may be any shape, such as a rectangular shape or an oval shape. In addition, a cross-sectional shape of the diaphragm 123 is a cross-sectional of a cone, but the cross-sectional shape of the diaphragm 123 may be any shape, such as a planar shape.

Furthermore, in the above description, the speaker units 12 are arranged in a straight line when seen from the front side of the speaker device 1, but this is not limitative. The speaker units 12 may be arranged in a curved line when seen from the front side of the speaker device 1. In addition, each speaker unit 12 is mounted in the cabinet 11 such that the front surface of the speaker unit 12 is in parallel to the arrangement direction, but this is not limitative. Each speaker unit 12 may be mounted in the cabinet 11 such that the front surface of the speaker unit 12 is inclined relative to the arrangement direction.

Furthermore, in the above description, a drive system of the speaker unit 12 is of an electrodynamic type, but any of a piezoelectric type, an electrostatic type, or an electromagnetic type may be adopted as the drive system.

Furthermore, in the above description, as the effective radius of the vibration region of the speaker unit 12, no specific value has been given as an example, but any value is acceptable. For example, the effective radius may be equal to or more than 2 [cm]. In such a case, the area of the effective vibration region is equal to or more than $4\pi$ [$cm^2$].

Embodiment 2

Figure 4:
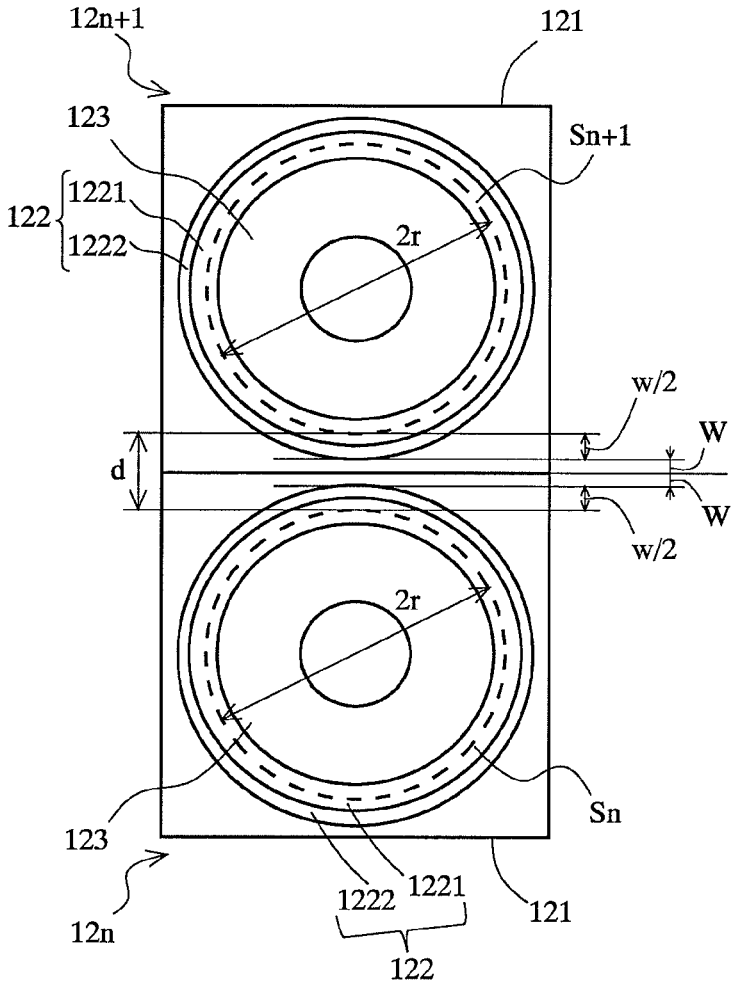
FIG. 4 is a diagram showing a part of FIG. 2, which corresponds to vibration regions of the speaker units 12.

The speaker device 1 according to Embodiment 1 is, because of the structure thereof, limited in reducing the interval d. FIG. 4 is a diagram showing a part of FIG. 2, which corresponds to the vibration regions of the speaker units 12. In FIG. 4, when the width of the surround 122 is defined as w, the width between the upper end of the vibration region $S_n$ and the upper end of the surround 122 of the speaker unit $\mathbf{12}_n$ is w/2, and the width between the lower end of the vibration region $S_{n+1}$ and the lower end of the surround 122 of the speaker unit $\mathbf{12}_{n+1}$ is w/2. In addition, in the speaker unit $\mathbf{12}_n$, the width between the upper end of the surround 122 and the upper end of the frame 121 is defined as W. In the speaker unit $\mathbf{12}_{n+1}$, the width between the lower end of the surround 122 and the lower end of the frame 121 is defined as W. At this time, the interval d is the sum of w and 2 W. It is structurally difficult to make the interval d smaller than the sum of w and 2 W. For example, when the diameter (nominal diameter) of each of the speaker units $\mathbf{12}_n$ and $\mathbf{12}_{n+1}$ is 8 [cm], the interval d is generally 30 [mm] at the minimum. Thus, the speaker device 1 according to Embodiment 1 is, because of the structure thereof, limited in reducing the interval d. Therefore, in Embodiment 2, a speaker device will be described which is capable of reducing the interval d as compared with in Embodiment 1, and easily setting the interval de to a value that satisfies the formula (2). Specifically, in the speaker device according to Embodiment 2, speaker units are mounted in a cabinet such that adhesion margins of adjacent surrounds overlap each other. The remaining parts of the structure and operations are the same as those of the speaker device 1, and a specific description thereof is omitted here.

Figure 5:
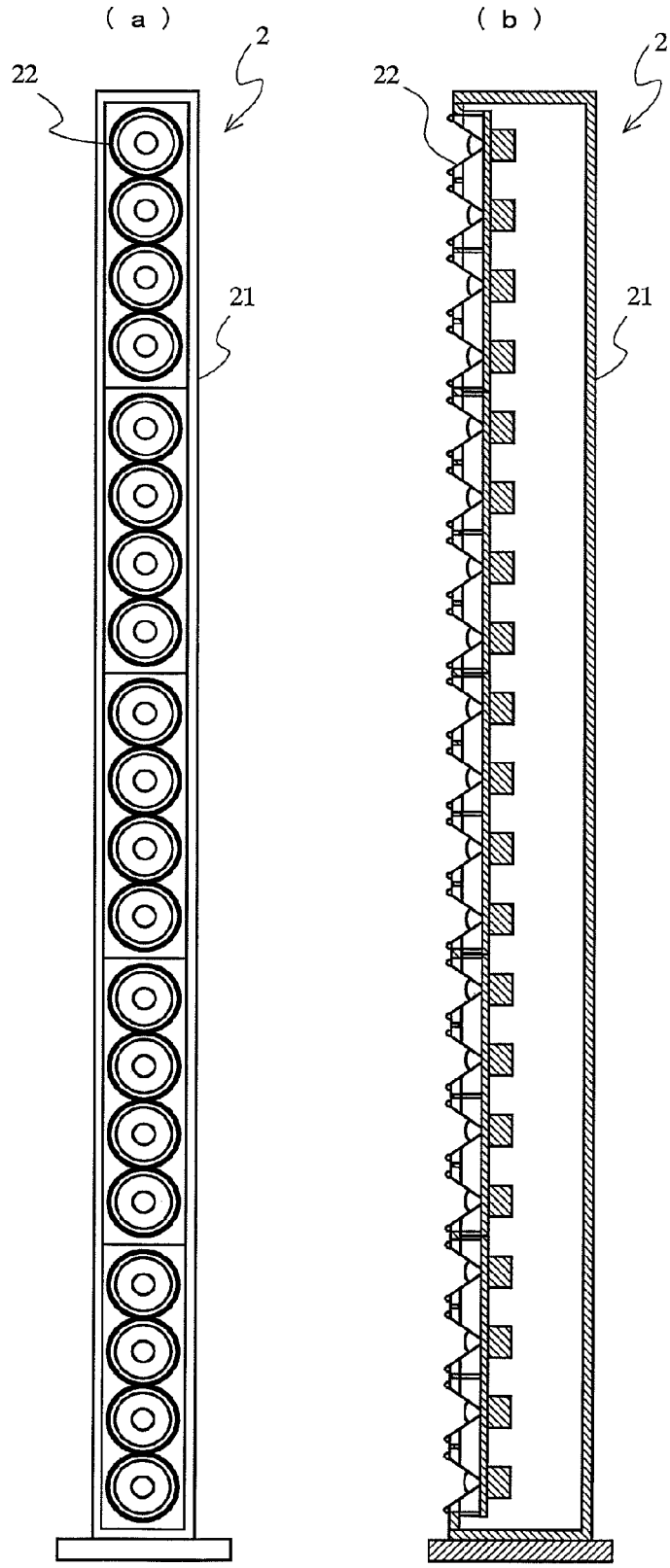
FIG. 5 is a diagram showing a structure of a speaker device according to Embodiment 2.

FIG. 5 is a diagram showing a structure of a speaker device according to Embodiment 2. In FIG. 5, (a) shows a front view of the speaker device, and (b) is a side view of the speaker device showing a cross-sectional structure thereof.

A speaker device 2 includes a cabinet 21 and a plurality of speaker modules 22, and is placed at home or the like where a listening position is at a short distance. In an example shown in FIG. 5, the speaker device 2 includes five speaker modules 22, but this is not limitative. Each speaker module 22 includes four speaker units, and is mounted on the front face of the cabinet 21. As shown in (a) of FIG. 5, the speaker units are arranged in a straight line, when seen from the front side of the speaker device 2, and the arrangement direction is parallel to the up-and-down direction of the speaker device 2. In addition, as shown in (b) of FIG. 5, the speaker units are arranged in a straight line, when seen from the lateral side of the speaker device 2. In (b) of FIG. 5, the structure section of each speaker module 22 is schematically shown. A detailed structure section is shown in FIG. 6.

Figure 6:
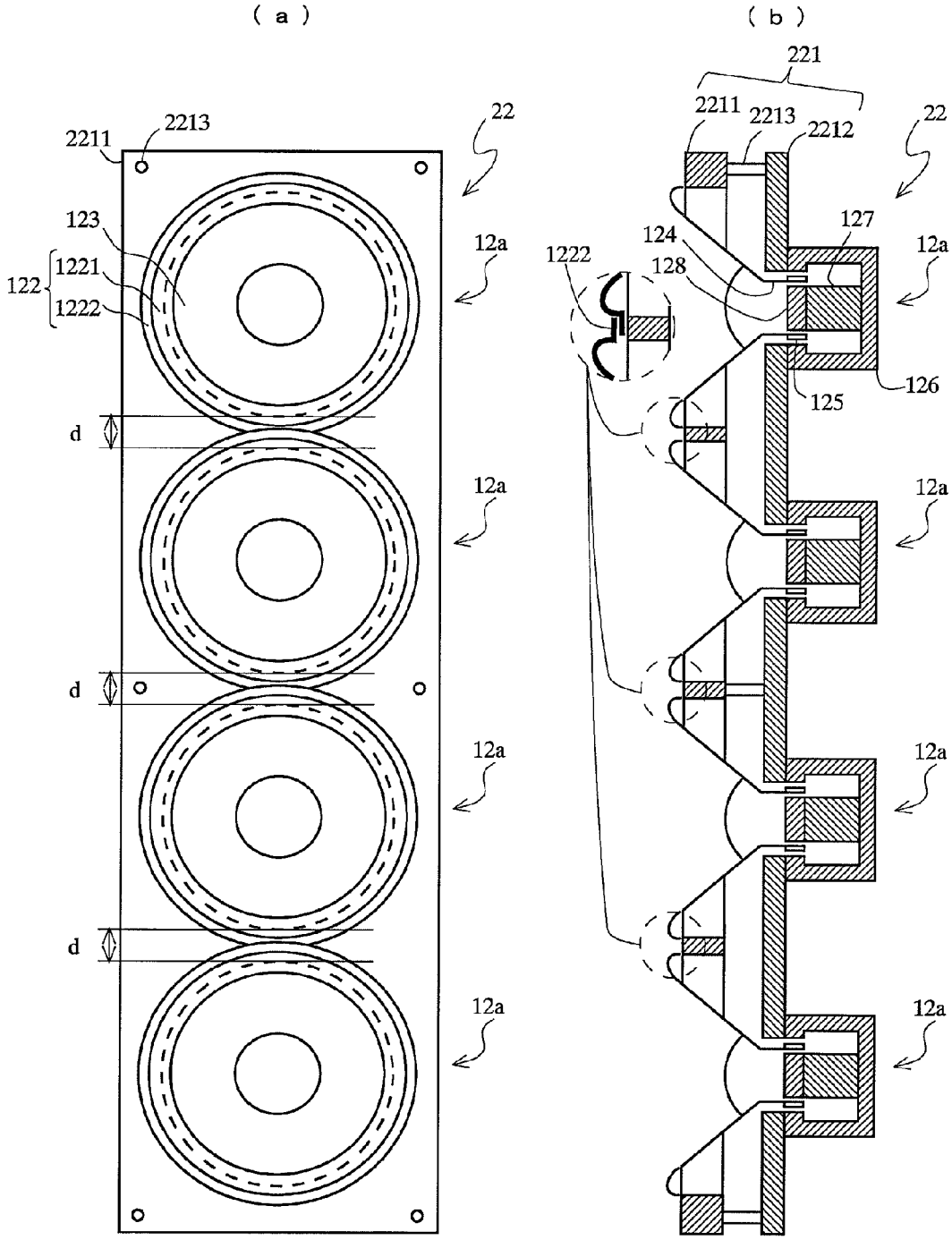
FIG. 6 is a diagram showing a structure of a speaker module 22.

FIG. 6 is a diagram showing a structure of a speaker module 22. In FIG. 6, (a) shows a front view of the speaker module 22, and (b) is a side view of the speaker module 22 showing a cross-sectional structure thereof. The speaker module 22 has a frame 221 and four speaker units 12*a*. The frame 221 has a front-face plate 2211, a support member 2212, and a coupling member 2213. The front-face plate 2211 and the support member 2212 are formed in a straight-line shape, as shown in (b) of FIG. 6. The coupling member 2213 for coupling the front-face plate 2211 and the support member 2212 to each other is provided between the front-face plate 2211 and the support member 2212. The structure of the speaker unit 12*a* is the same as the structure of the speaker unit 12, except that the frame 121 is not provided in the speaker unit 12*a*. The speaker unit 12*a* includes a surround 122, a diaphragm 123, a voice coil bobbin 124, a voice coil 125, a yoke 126, a magnet 127, and a plate 128. The surround 122 includes a round portion 1221 and an adhesion margin 1222. The adhesion margin 1222 is adhered to the front-face plate 2211, and an inner circumference of the round portion 1221 is adhered to an outer circumference of the diaphragm 123. Thus, the diaphragm 123 is supported on the front-face plate 2211 so as to be vibratable. As shown by an enlarged view which is enclosed with a dotted line in (b) of FIG. 6, the adhesion margins 1222 are adhered to the front-face plate 2211 such that adjacent adhesion margins 1222 partly overlap each other. An inner circumference of the diaphragm 123 is adhered to one end of the voice coil bobbin 124 which is positioned in a through hole formed through the support member 2212. The voice coil 125 is wound on the voice coil bobbin 124. The yoke 126 is attached to the support member 2212 so as to surround the through hole formed through the support member 2212. One face of the magnet 127 is adhered to the inner surface of the yoke 126, and the plate 128 is adhered to the other face of the magnet 127. A magnetic gap is formed between the side surface of the plate 128 and the inner surface of the yoke 126, and the voice coil 125 is positioned in the magnetic gap. A circle, which is illustrated with a dotted line on the speaker unit 12*a*, is a vibration region of the speaker unit 12*a*.

Thus, in the present embodiment, the speaker units 12*a* are arranged such that the adhesion margins 1222 thereof overlap each other, as shown in (a) of FIG. 6. This makes the interval d between the vibration regions smaller than the interval d shown in FIG. 4. That is, the interval d can be reduced as compared with in the speaker device 1. In the present embodiment, therefore, the interval de can be easily set to a value that satisfies the formula (2), and a deterioration of sound quality due to a phase interference can easily be prevented.

Moreover, in the present embodiment, since there is the surround 122 between the diaphragms 123 of the respective speaker units 12*a*, the diaphragms 123 vibrate independently of each other. This can prevent an unnecessary resonance, which may otherwise be caused by mutual transmission of vibrations of the diaphragms 123. Thus, all the speaker units 12*a* can vibrate in the same phase.

In the above description, the speaker module 22 includes four speaker units 12*a*, but this is not limitative. For example, the speaker module 22 may include twenty speaker units 12*a* so that the speaker device 2 has one speaker module 22.

Moreover, in the above description, each speaker unit 12*a* has the surround 122, but this is not limitative. The surrounds 122 may be integrally formed with the adhesion margins 1222 thereof overlapping each other, and the integrally-formed surround may be shared by the speaker units 12*a*.

Furthermore, in the above description, all of the speaker units 12*a* are arranged such that the adhesion margins 1222 thereof overlap each other. However, only two speaker units 12*a* may be arranged such that the adhesion margins 1222 thereof overlap each other. Moreover, all of the speaker units 12*a* may be arranged such that the adhesion margins 1222 thereof do not overlap each other. Even in this case, the speaker units 12*a* share the one frame 221. Therefore, the interval d between the vibration regions of the respective speaker units 12*a* can be reduced as compared with when each speaker unit 12*a* has a frame.

Furthermore, in the above description, the cabinet 21 is provided as one of the components of the speaker device 2, but the cabinet 21 may be removed from the components of the speaker device 2. In such a case, the speaker device 2 is exactly the speaker module 22.

Furthermore, in the above description, it is assumed that the differential distance Q satisfies the condition of the formula (2). However, even when the formula (2) is not satisfied, a deterioration of sound quality due to a phase interference can be suppressed by adhesion margins of adjacent surrounds overlapping each other, as compared with when adhesion margins of adjacent surrounds do not overlap each other.

Embodiment 3

In the speaker device 1 according to Embodiment 1, the plurality of speaker units 12 are arranged in a straight line, when seen from the lateral side of the speaker device 1, as shown in (b) of FIG. 1. In contrast, in Embodiment 3, a case will be described in which a plurality of speaker units are arranged in an arc when seen from a lateral side of the speaker device. The remaining parts of the structure and operations are the same as those of the speaker device 1, and a description thereof is omitted here.

Figure 7:
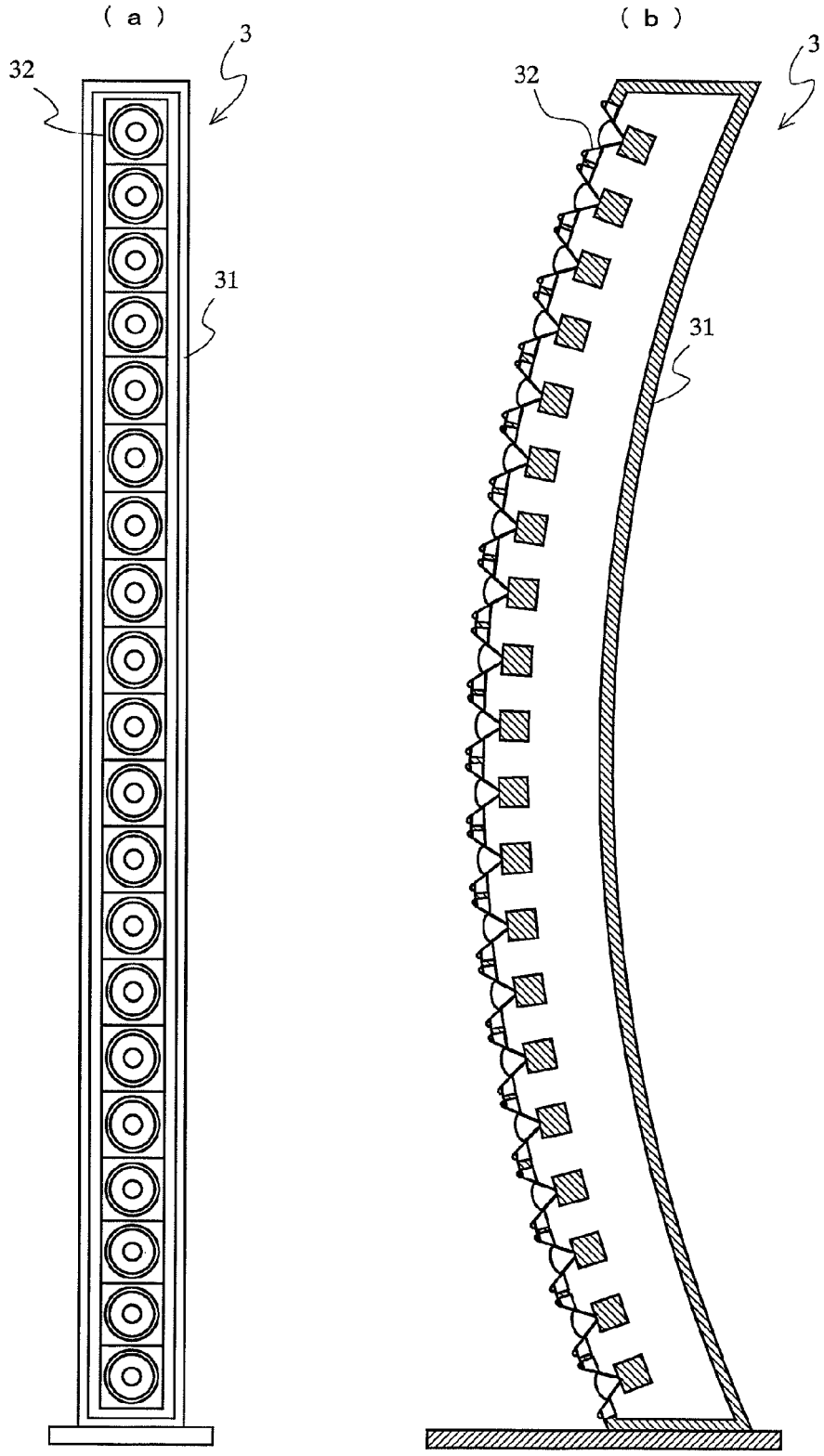
FIG. 7 is a diagram showing a structure of a speaker device according to Embodiment 3.

FIG. 7 is a diagram showing a structure of a speaker device according to Embodiment 3 of the present invention. In FIG. 7, (a) shows a front view of the speaker device, and (b) is a side view of the speaker device showing a cross-sectional structure thereof.

A speaker device 3 includes a cabinet 31 and a plurality of speaker units 32, and is placed at home or the like where a listening position is at a short distance. In an example shown in FIG. 7, the speaker device 3 includes twenty speaker units 32, but this is not limitative. Each speaker unit 32 is mounted in the cabinet 31 such that the front surface of the speaker unit 32 faces the front side of the cabinet 31. As shown in (a) of FIG. 7, the speaker units 32 are arranged in a straight line, when seen from the front side of the speaker device 3, and the arrangement direction is parallel to the up-and-down direction of the speaker device 3. In addition, as shown in (b) of FIG. 7, the speaker units 32 are arranged in an arc, when seen from the lateral side of the speaker device 3. Each speaker unit 32 has the same structure section as that of an ordinary electrodynamic speaker. In (b) of FIG. 7, the structure section of each speaker unit 32 is schematically shown.

Hereinafter, a manner of arrangement of the speaker unit 32 according to the present embodiment will be described.

In the present embodiment, similarly to in Embodiment 1, a plurality of sound sources, that is, a plurality of speaker units 32 are arranged such that the differential distance Q is less than half the wavelength of a sound at the upper limit frequency of a reproduction band of the speaker unit 32. As a result, the sound source produced by the speaker device 3 can be closer to an ideal line source, and a peak/dip due to a phase interference can be prevented from occurring in the reproduction band. That is, a deterioration of sound quality due to the phase interference can be prevented.

Figure 8:
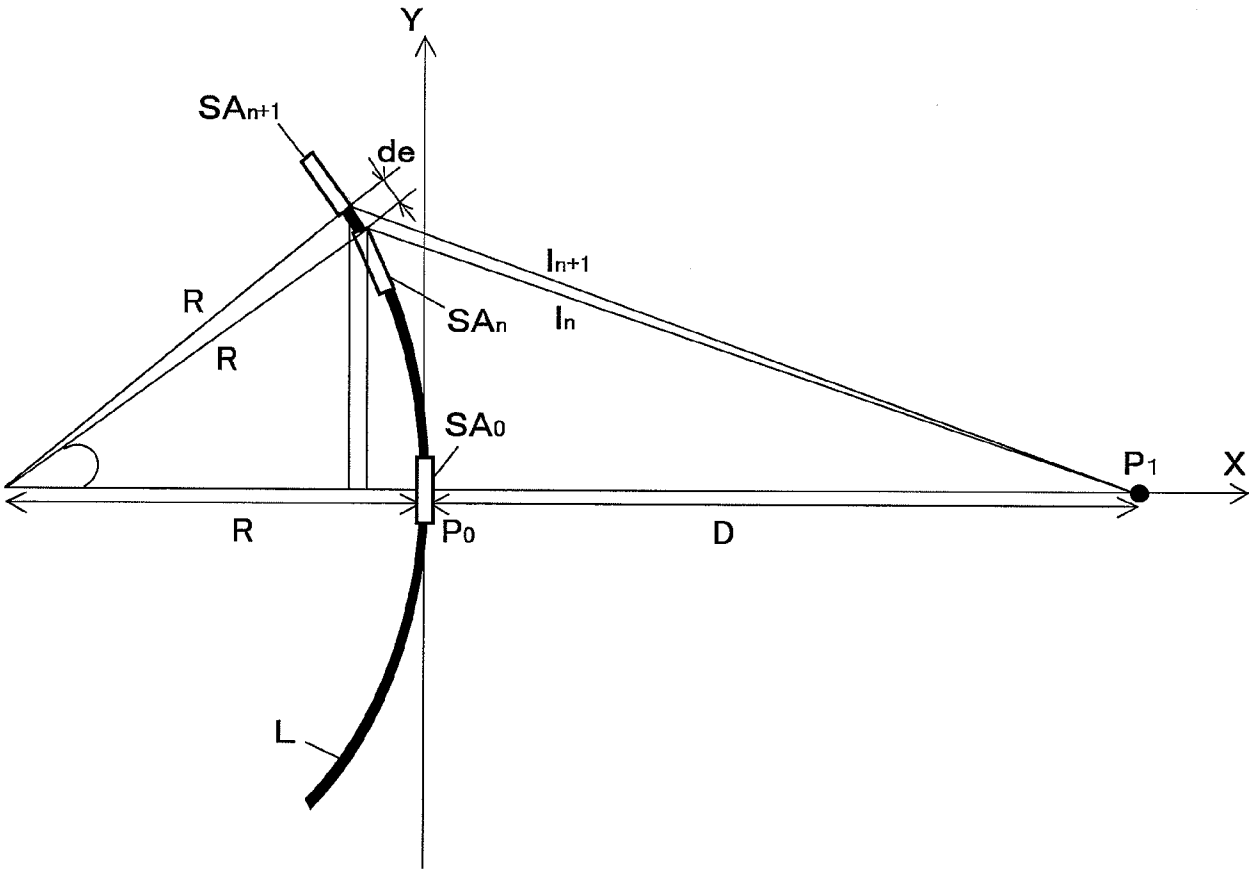
FIG. 8 is a diagram for illustrating a condition for a differential distance Q according to Embodiment 3.

Here, as shown in (b) of FIG. 7, the speaker units 32 are arranged in an arc, when seen from the lateral side of the speaker device 3. Therefore, a condition for the differential distance Q is represented by a formula different from the formula (2) explained in Embodiment 1. In the following, a condition for the differential distance Q according to Embodiment 3 will be specifically described with reference to FIG. 8. FIG. 8 is a diagram for illustrating a condition for the differential distance Q according to Embodiment 3. An interval between effective vibration regions of the speaker units 32 is the same as described with reference to FIG. 2, and therefore a description thereof is omitted here.

In FIG. 8, the center $P_0$ of the arrangement of the speaker units 32 is defined as the origin on the Y-axis, and the arrangement length (the length of the arc) of the speaker units 32 is defined as L. A listening position $P_1$ is located on the X-axis that passes through the center $P_0$. A listening distance between the listening position $P_1$ and the center $P_0$ is defined as D. An effective vibration region of the speaker unit 32 arranged at the center $P_0$ is defined as $SA_0$. The n-th effective vibration region counted from the effective vibration region $SA_0$ toward the Y-axis positive direction is defined as $SA_n$, and the n+1-th effective vibration region is defined as $SA_{n+1}$. When a region that is positioned symmetrically to the effective vibration region $SA_n$ with respect to the X-axis is defined as $SA_n'$, the length of an arc extending from the upper end of the effective vibration region $SA_n$ to the lower end of the region $SA_n'$ is defined as L. An interval between the effective vibration region $SA_n$ and the effective vibration region $SA_{n+1}$ is an interval de which is shown in FIG. 8, and represented by the above formula (1). A curvature radius of the arc is defined as R. At this time, the differential distance Q is represented by a difference between a distance $l_n$ and a distance $l_{n+1}$. The distance $l_n$ is from the upper end of the effective vibration region $SA_n$, which forms the interval de, to the listening position $P_1$. The distance $l_{n+1}$ is from the lower end of the effective vibration region $SA_{n+1}$ to the listening position $P_1$. This difference has to be less than half the wavelength of the reproduced sound at the upper limit frequency of the reproduction band of the speaker unit 32. When the wavelength of the reproduced sound at the upper limit frequency of the reproduction band of the speaker unit 32 is defined as λ, the specific condition for the differential distance Q is represented by the formula (3).

[Formula 3]

$$Q = l_{n+1} - l_n = \sqrt{\left(R\sin\frac{L_n + d_e}{2R}\right)^2 + \left\{R\left(1 - \cos\frac{L_n + d_e}{2R}\right) + D\right\}^2} - \sqrt{\left(R\sin\frac{L_n}{2R}\right)^2 + \left\{R\left(1 - \cos\frac{L_n}{2R}\right) + D\right\}^2} < \frac{\lambda}{2} \quad (3)$$

Figure 9:
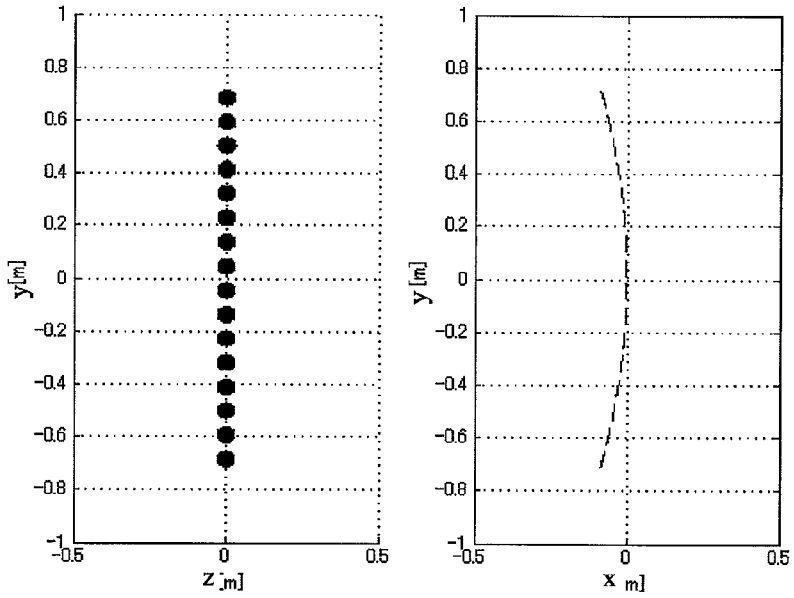
FIG. 9 is a diagram showing an arrangement length L and a curvature radius R of speaker units 32.
Figure 1:
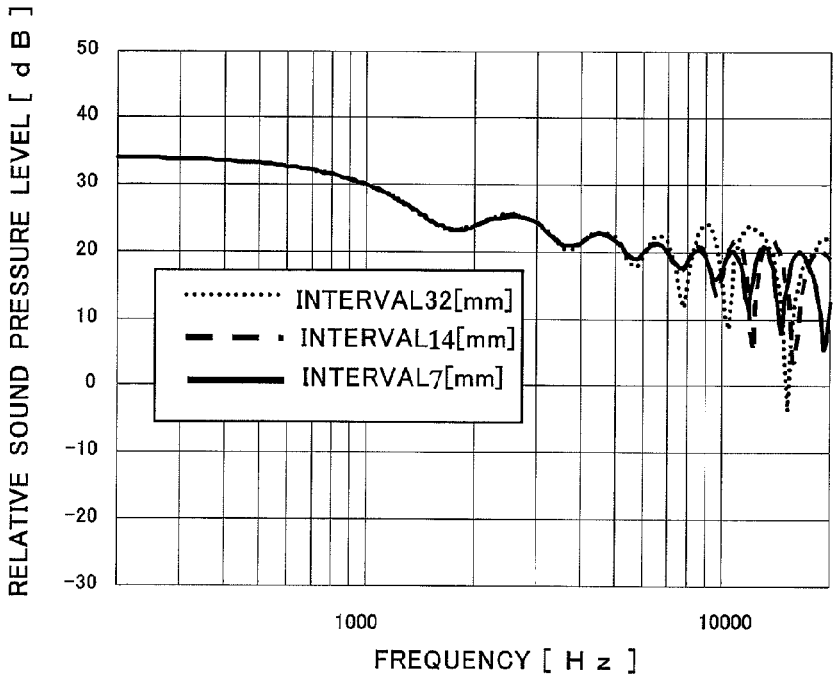

When the differential distance Q satisfies the formula (3), and when the diameter (nominal diameter) of the speaker unit 32 is set to 8 [cm] (that is, the effective diameter of the vibration region of the speaker unit 32 is set to 6 [cm]) and, as shown in FIG. 9, the arrangement length L and the curvature radius R of the speaker units 32 are set to 1.5 [m] and 3 [m], respectively, the length of the interval d in the formula (1) is 0.0134 [m]=13.4 [mm]. FIG. 9 is a diagram showing the arrangement length L and the curvature radius R of the speaker units 32. The Z-axis shown in FIG. 9 is an axis perpendicular to each of the X-axis and Y-axis shown in FIG. 8. The sound pressure/frequency characteristics exhibited when the interval d is changed while the arrangement length L is kept constant is shown in FIG. 10. The sound pressure/frequency characteristics shown in FIG. 10 are calculated values obtained when the upper limit frequency of the reproduction band is set to 10 [kHz] and the listening position $P_1$ is set to the position of 3 [m] from the center $P_0$ of the arrangement of the speaker units 32. As shown in FIG. 10, as the interval d in the formula (1) is smaller (that is, as the interval de is smaller), the differential distance Q is reduced, and therefore a peak/dip due to a phase interference is less caused.

As described above, in the present embodiment, the plurality of speaker units 32 are arranged such that the differential distance Q is less than half the wavelength of the reproduced sound at the upper limit frequency of the reproduction band of the speaker unit 12. As a result, the sound source produced by the speaker device 3 can be closer to an ideal line source, and a peak/dip due to a phase interference can be prevented from occurring in the reproduction band. That is, a deterioration of sound quality due to the phase interference can be prevented.

Here, in the above-described speaker device 1, the speaker units 12 are arranged in a straight line, when seen from the lateral side of the speaker device 1. Accordingly, in the above-described speaker device 1, as the wavelength of the reproduced sound, relative to the arrangement length L of the speaker units 12, becomes shorter, the directivity in the arrangement direction becomes sharper, and a range (hereinafter referred to as a sound field range) in which a desired sound field is obtained is narrowed. Therefore, it is necessary to make the arrangement length L longer, in order that, in a range in which the wavelength of the reproduced sound is short (that is, in a high frequency range), the above-described speaker device 1 can give a desired sound field range to the directivity in the arrangement direction. For example, when a sound in a frequency band of 10 [kHz] or lower is reproduced at a short distance, the arrangement length L has to be 3 [m], and therefore it is not actually practical to use the speaker device 1 at home.

Figure 11:
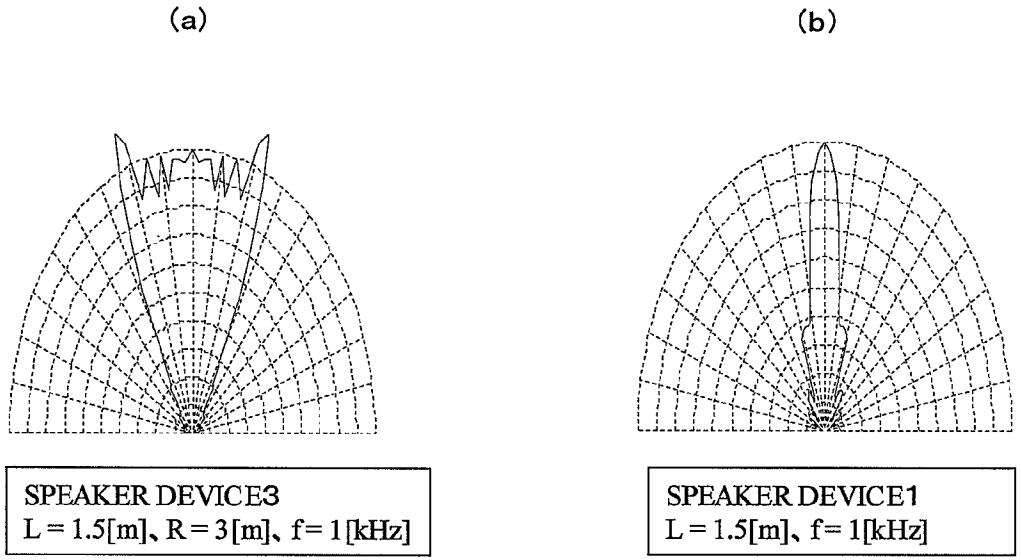
FIG. 11 is a diagram showing a directivity, in an arrangement direction, of each of speaker devices 1 and 3 having the same arrangement length L.

On the other hand, in the speaker device 3 according to the present Embodiment 3, the speaker units 32 are arranged in an arc, when seen from the lateral side of the speaker device 3. Accordingly, in the speaker device 3, the directivity in the arrangement direction is less sharp than in the speaker device 1 which has the same arrangement length L, and a desired sound field range obtained is wider than in the speaker device 1. FIG. 11 is a diagram showing a directivity, in the arrangement direction, of each of the speaker devices 1 and 3 having the same arrangement length L. In FIG. 11, (a) shows a directivity of the speaker device 3, and (b) shows a directivity of the speaker device 1. In FIG. 11, the curvature radius R and the arrangement length L of the speaker device 3 are set to 3 [m] and 1.5 [m], respectively, and the arrangement length L of the speaker device 1 is set to 1.5 [m]. FIG. 11 shows, as an example, the directivity exhibited when a frequency f is 1 [kHz]. The result shown in FIG. 11 indicates that the directivity, in the arrangement direction, of the speaker device 3 is less sharp than that of the speaker device 1 having the same arrangement length L, and can obtain a desired sound field range that is wider than in the speaker device 1. In addition, the result shown in FIG. 11 also indicates that the broadness of the directivity, in the arrangement direction, of the speaker device 3 having a curvature radius R of 3 [m] and an arrangement length L of 1.5 [m] is equivalent to or more than that of the speaker device 1 having an arrangement length L of 3 [m]. That is, for obtaining a desired sound field range in the arrangement direction, the speaker device 3 can have a shorter arrangement length L than that of the speaker device 1, and consequently the size of the speaker device 3 can be made smaller than that of the speaker device 1.

As described above, it can be understood that, in the speaker device 3 according to the present Embodiment 3, the speaker units 32 are arranged in an arc when seen from the lateral side of the speaker device 3, which enables the speaker device 3 to obtain a desired sound field range that is wider than in the speaker device 1. As a result, the size of the speaker device 3 can be made smaller than the size of the speaker device 1, while ensuring a sound field range that is equivalent to the sound field range, in the arrangement direction, of the speaker device 1 having a long arrangement length.

Figure 12:
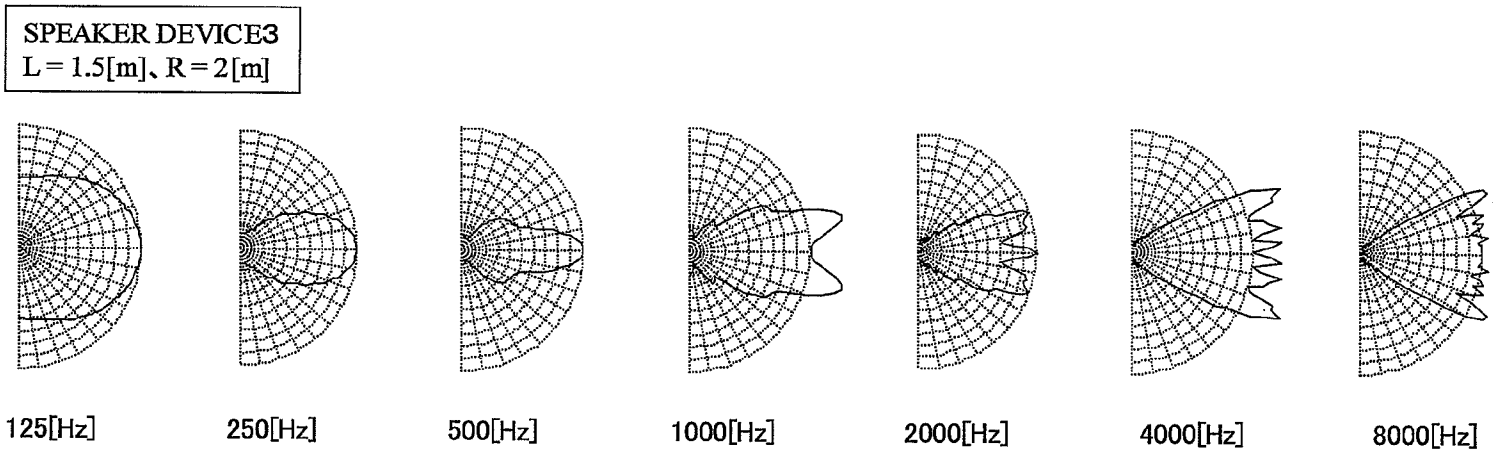
FIG. 12 is a diagram showing, for each frequency, a directivity of the speaker device 3 in the arrangement direction.
Figure 13:
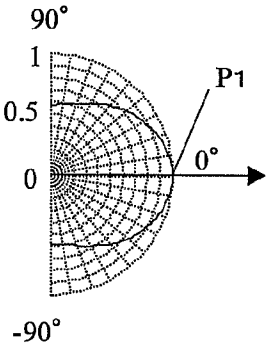
FIG. 13 is a diagram showing a directivity which serves as a standard for normalization.

In a case where the speaker units 32 are arranged in an arc when seen from the lateral side of the speaker device 3; as the ratio between the wavelength of the reproduced sound and the arrangement length approaches a predetermined value, the directivity in the arrangement direction becomes sharper. For example, when the arrangement length is fixed, the shorter the wavelength of the reproduced sound becomes, the sharper the directivity becomes. However, when the wavelength of the reproduced sound becomes shorter than a predetermined wavelength, the directivity becomes less sharp. As shown in FIG. 12, in the speaker device 3 having an arrangement length of 1 [m] to 2 [m], which is intended to be used at home, the frequency band in which the directivity in the arrangement direction is sharpest is 250 [Hz] to 2 [kHz]. FIG. 12 is a diagram showing, for each frequency, a directivity of the speaker device 3 in the arrangement direction. In FIG. 12, as an example, the arrangement length L is set to 1.5 [m], and the curvature radius R is set to 2 [m]. The result shown in FIG. 12 was obtained by normalizing sound pressure with the sound pressure at the listening position $P_1$ being defined as 1, as shown in FIG. 13. Therefore, the arrangement length L and the curvature radius R may be set such that a desired sound field range can be obtained in the frequency band in which the directivity in the arrangement direction is sharpest. Thus, a sufficient listening area can be ensured in the entire reproduction band.

For example, when, in a frequency band of 250 [Hz] to 2 [kHz] in which the directivity in the arrangement direction is sharpest, a difference in the sound pressure, at a listening position that is at an elevation angle of ±15 [°] with respect to the center of the arrangement of the speaker units 32, is equal to or less than 6 [dB], the arrangement length L and the curvature radius R have to satisfy the condition of the formula (4). In the formula (4), a listening distance from the center of the arrangement of the speaker units 32 to the listening position is defined as D (1 [m] to 3 [m]).

[Formula 4]

$$(R+D)\cdot\frac{L}{R}\geq D \tag{4}$$

Figure 14:
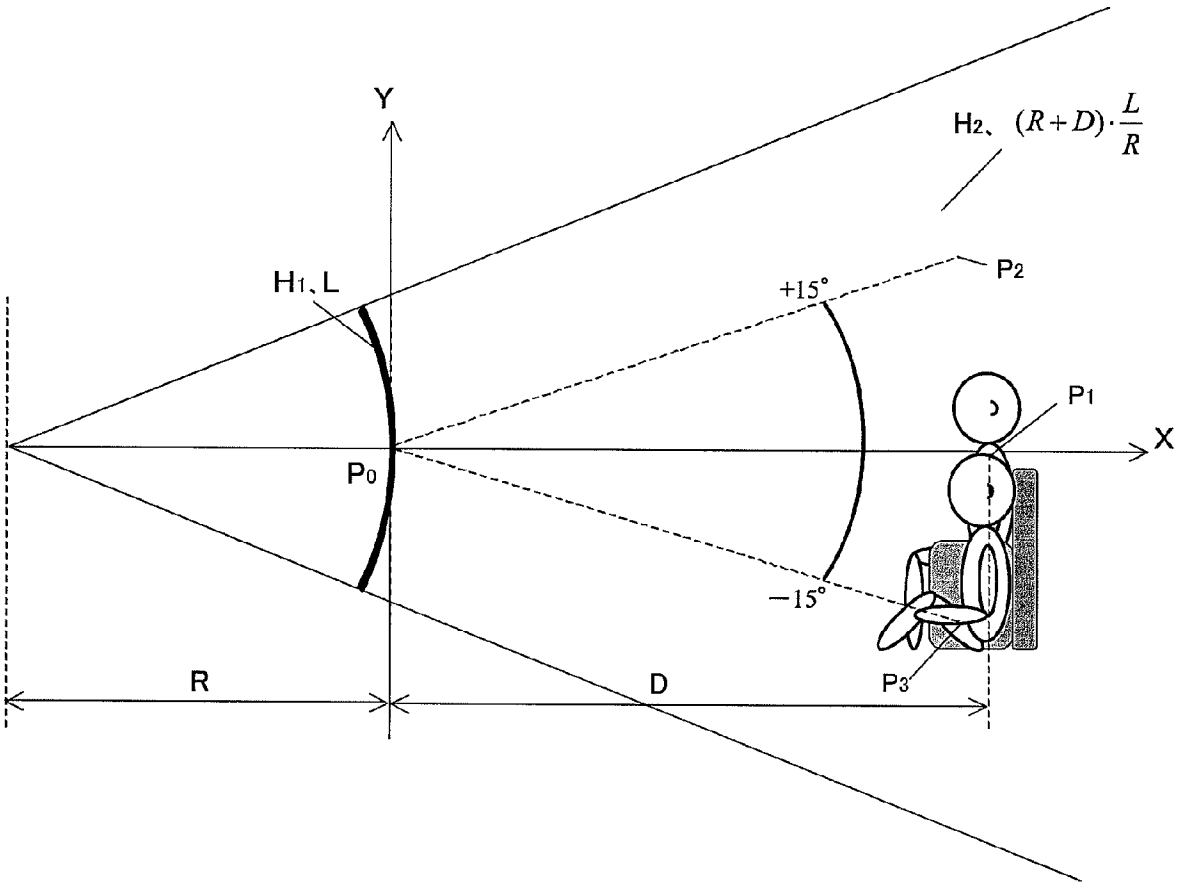
FIG. 14 is a diagram showing contents of the formula (4).
Figure 15:
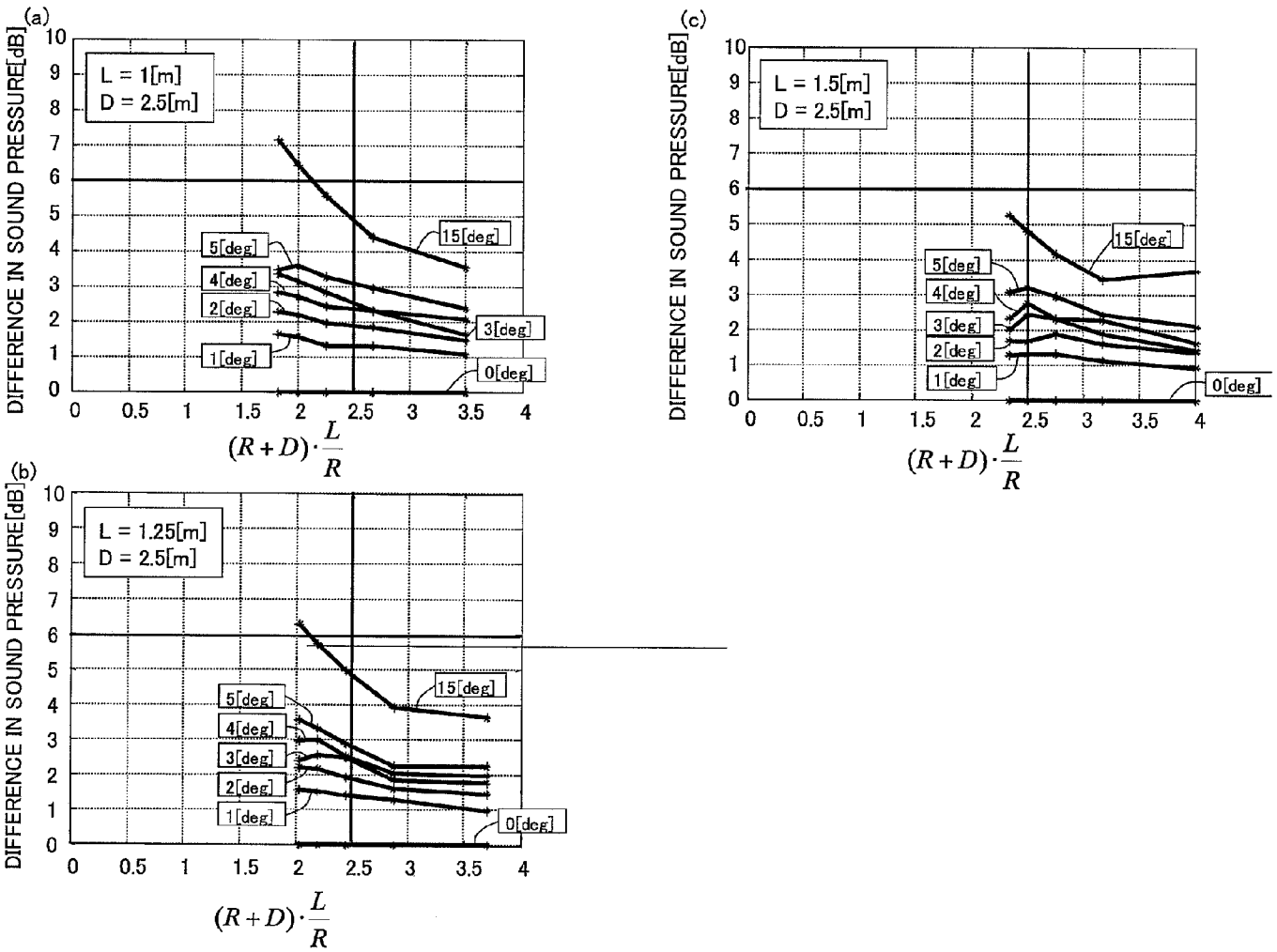
FIG. 15 is a diagram showing a result of confirming, by a numerical calculation, that a difference in sound pressure is equal to or less than 6 [dB]

FIG. 14 is a diagram showing contents of the formula (4). In FIG. 14: the center $P_0$ of the arrangement of the speaker units 32 is defined as the origin on the Y-axis; the arrangement of the speaker units 32 is defined as $H_1$; and the arrangement length (the length of the arc) of the speaker units 32 is defined as L. The listening position $P_1$ is a listening position at an elevation angle of 0 [°], and located on the X-axis that passes through the center $P_0$. A listening distance between the listening position $P_1$ and the center $P_0$ is defined as D, and the curvature radius of the arc is defined as R. A listening position at an elevation angle of +15 [°] is defined as $P_2$, and a listening position at an elevation angle of −15 [°] is defined as $P_3$. In this condition, the right of the formula (4) indicates the length of an arc $H_2$ which is similar to the arrangement $H_1$ and that passes through the listening positions $P_1$ to $P_3$. When the right of the formula (4) is equal to or larger than the listening distance D, a difference in the sound pressure of the reproduced sound at a listening position, which may be any position between the listening position $P_2$ and the listening position $P_3$, is equal to or less than 6 [dB]. A result of confirming, by a numerical calculation, that the difference in the sound pressure is equal to or less than 6 [dB] is shown in FIG. 15. In FIG. 15: (a) shows a numerical calculation result obtained when the listening distance D is 2.5 [m] and the arrangement length L is 1 [m]; (b) shows a numerical calculation result obtained when the listening distance D is 2.5 [m] and the arrangement length L is 1.25 [m]; and (c) shows a numerical calculation result obtained when the listening distance D is 2.5 [m] and the arrangement length L is 1.5 [m]. In FIG. 15, a numerical calculation result for the listening position at an elevation angle 0 [°] to +15 [°] is shown as an example. The result shown in (a) to (c) of FIG. 15 indicates that, when a value indicated by the right of the formula (4) is equal to or larger than the listening distance D (=2.5 [m]), the difference in the sound pressure of the reproduced sound at a listening position, which may be any position between the listening position $P_1$ and the listening position $P_2$, is equal to or less than 6 [dB].

Figure 16:
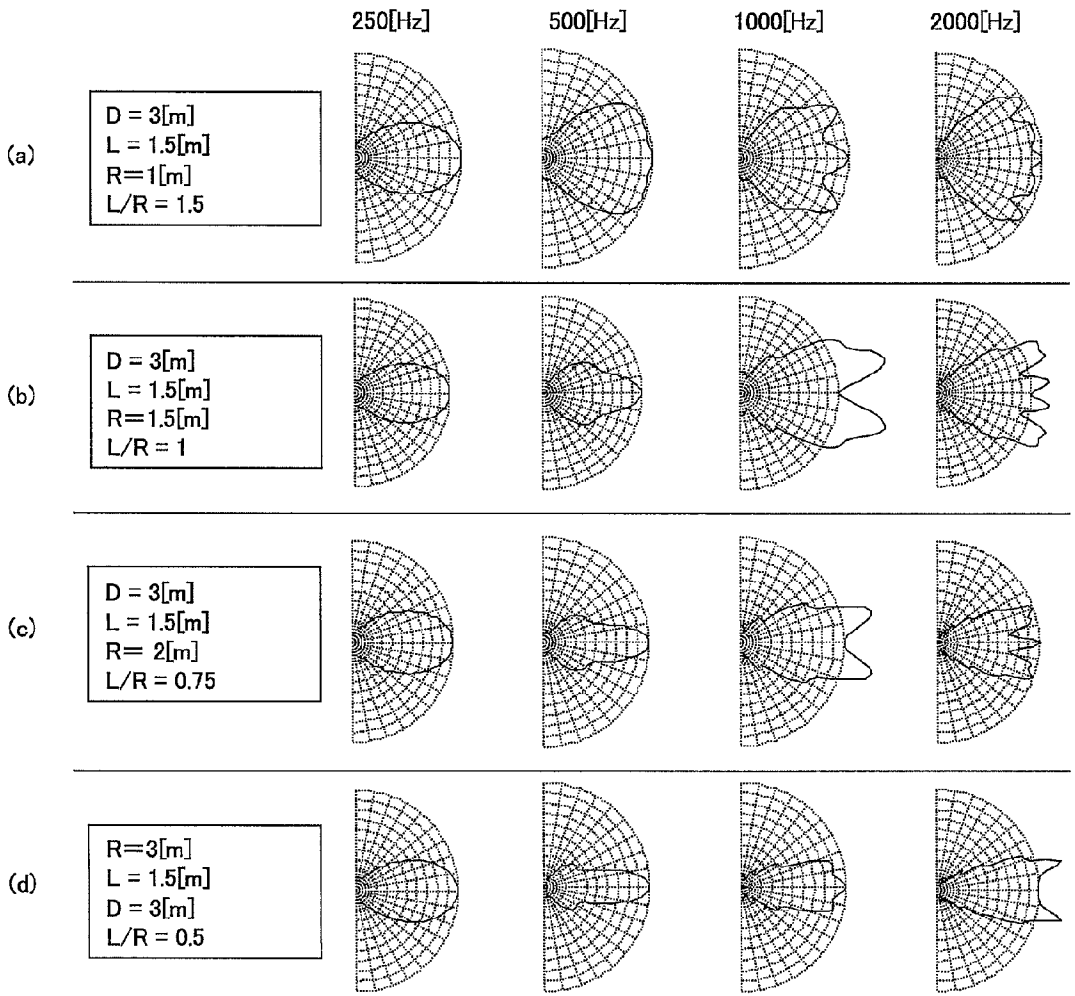
FIG. 16 is a diagram showing, for each frequency, a directivity of the speaker device 3 in the arrangement direction, when a listening distance D is 3 [m].
Figure 1:
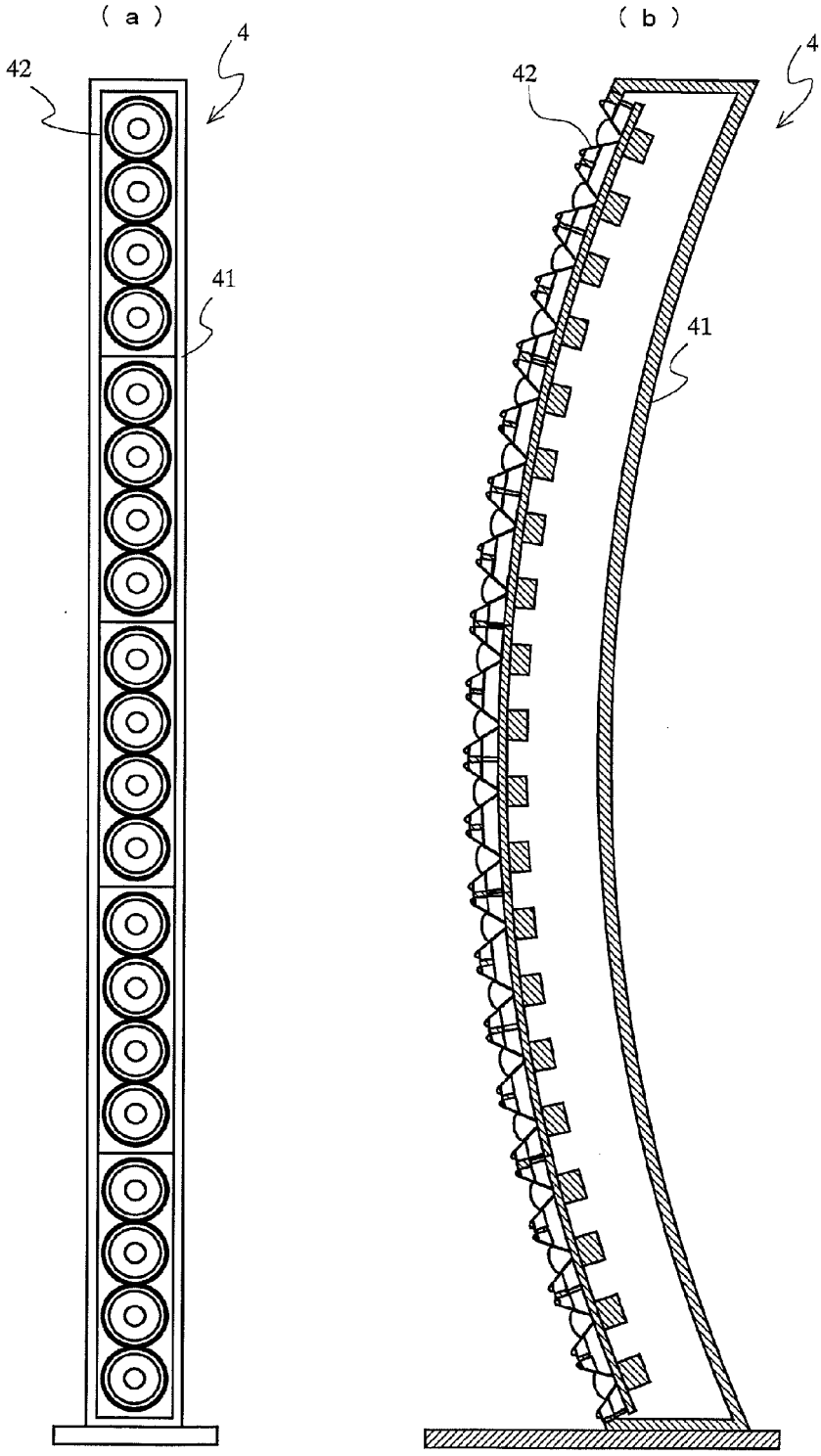
Figure 1:
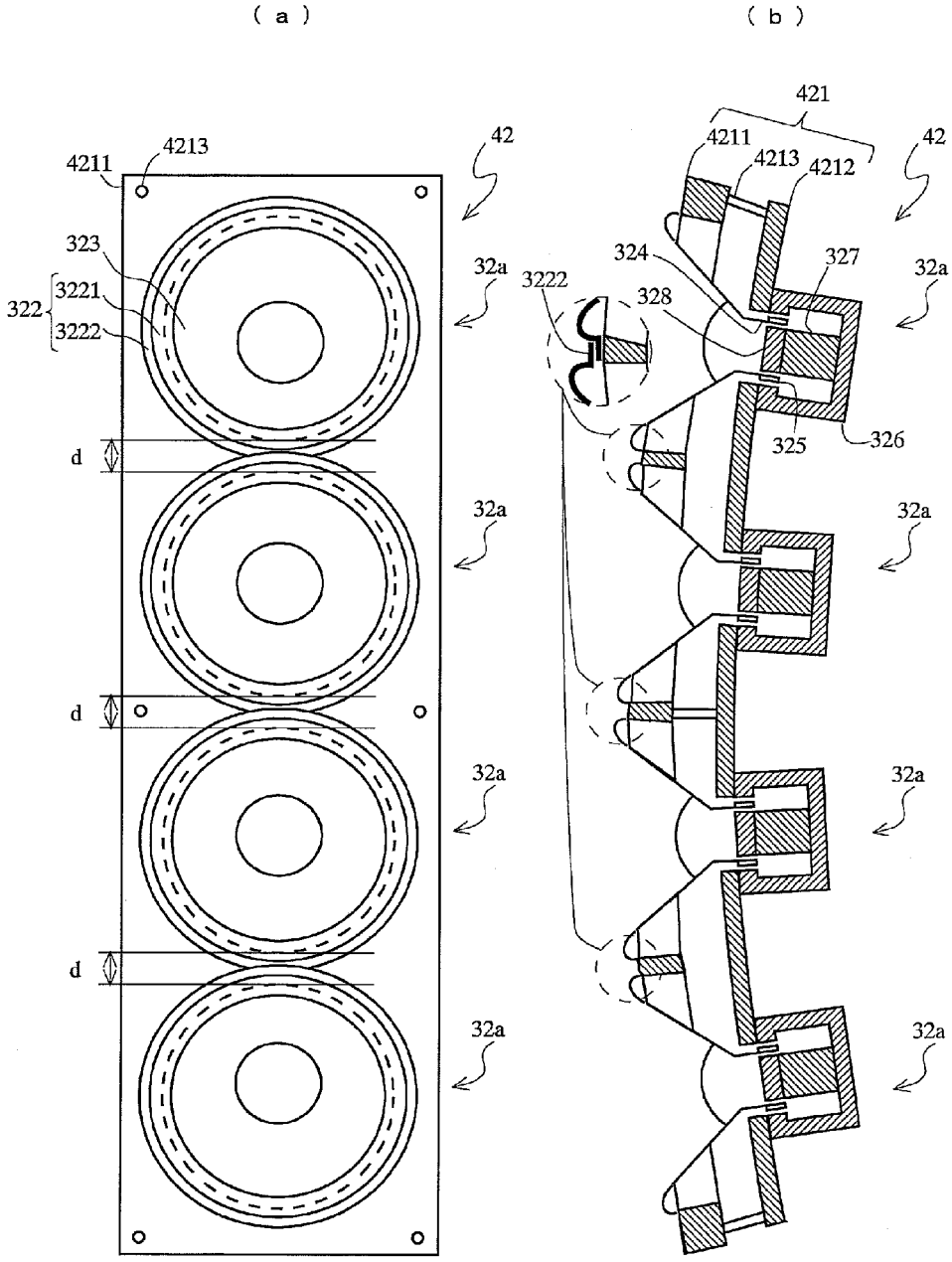

Separately from the contents described with reference to FIGS. 12 to 15, when the listening distance D is equal to or less than 5 [m], the arrangement length L and the curvature radius R may be set such that a resultant (L/R) obtained by dividing the arrangement length L by the curvature radius R is equal to or greater than 1.5. When the listening distance D is 3 [m], the arrangement length L and the curvature radius R may be set such that a resultant (L/R) obtained by dividing the arrangement length L by the curvature radius R is equal to or greater than 0.5. FIG. 16 is a diagram showing, for each frequency, a directivity of the speaker device 3 in the arrangement direction, when the listening distance D is 3 [m]. In FIG. 16: (a) shows a directivity when the resultant (L/R) of the division is set to 1.5; (b) shows a directivity when the resultant (L/R) of the division is set to 1; (c) shows a directivity when the resultant (L/R) of the division is set to 0.75; and (d) shows a directivity when the resultant (L/R) of the division is set to 0.5. From FIG. 16, it can be seen that, when the listening distance D is 3 [m], the resultant (L/R) of the division being equal to or greater than 0.5 causes the directivity in the arrangement direction to have such a broadness that a sufficient sound field range can be obtained.

Embodiment 4

Similarly to the speaker device 1, the speaker device 3 according to Embodiment 3 is, because of the structure thereof, limited in reducing the interval d. Therefore, in Embodiment 4, a speaker device will be described which is capable of reducing the interval d as compared with in Embodiment 3, and easily setting the interval de to a value that satisfies the formula (2). Specifically, in the speaker device according to Embodiment 4, a speaker unit is mounted in a cabinet such that adhesion margins of adjacent surrounds overlap each other. The remaining parts of the structure and operations are the same as those of the speaker device 3, and a specific description thereof is omitted here.

FIG. 17 is a diagram showing a structure of a speaker device according to Embodiment 4. In FIG. 17, (a) shows a front view of the speaker device, and (b) is a side view of the speaker device showing a cross-sectional structure thereof.

A speaker device 4 includes a cabinet 41 and a plurality of speaker modules 42, and is placed at home or the like where a listening position is at a short distance. In an example shown in FIG. 17, the speaker device 4 includes five speaker modules 42, but this is not limitative. Each speaker module 42 includes four speaker units, and is mounted on the front face of the cabinet 41. As shown in (a) of FIG. 17, the speaker units are arranged in a straight line, when seen from the front side of the speaker device 4, and the arrangement direction is parallel to the up-and-down direction of the speaker device 4. In addition, as shown in (b) of FIG. 17, the speaker units are arranged in an arc, when seen from the lateral side of the speaker device 4. In (b) of FIG. 17, the structure section of each speaker module 42 is schematically shown. A detailed structure section is shown in FIG. 18.

FIG. 18 is a diagram showing a structure of the speaker module 42. In FIG. 18, (a) shows a front view of the speaker module 42, and (b) is a side view of the speaker module 42 showing a cross-sectional structure thereof. The speaker module 42 has a frame 421 and four speaker units 32*a*. The frame 421 has a front-face plate 4211, a support member 4212, and a coupling member 4213. The front-face plate 4211 and the support member 4212 are formed in an arc shape, as shown in (b) of FIG. 18. The coupling member 4213 for coupling the front-face plate 4211 and the support member 4212 to each other is provided between the front-face plate 4211 and the support member 4212. The structure of the speaker unit 32*a* is the same as the structure of the speaker unit 32, except that the frame is not provided in the speaker unit 32*a*. The speaker unit 32*a* includes a surround 322, a diaphragm 323, a voice coil bobbin 324, a voice coil 325, a yoke 326, a magnet 327, and a plate 328. The surround 322 includes a round portion 3221 and an adhesion margin 3222. The adhesion margin 3222 is adhered to the front-face plate 4211, and an inner circumference of the round portion 3221 is adhered to an outer circumference of the diaphragm 323. Thus, the diaphragm 323 is supported on the front-face plate 4211 so as to be vibratable. As shown by an enlarged view which is enclosed with a dotted line in (b) of FIG. 18, the adhesion margins 3222 are adhered to the front-face plate 4211 such that adjacent adhesion margins 3222 partly overlap each other. An inner circumference of the diaphragm 323 is adhered to one end of the voice coil bobbin 324 which is positioned in a through hole formed through the support member 4212. The voice coil 325 is wound on the voice coil bobbin 324. The yoke 326 is attached to the support member 4212 so as to surround the through hole formed through the support member 4212. One face of the magnet 327 is adhered to the inner surface of the yoke 326, and the plate 328 is adhered to the other face of the magnet 327. A magnetic gap is formed between the side surface of the plate 328 and the inner surface of the yoke 326, and the voice coil 325 is positioned in the magnetic gap. A circle, which is illustrated with a dotted line on the speaker unit 32*a*, is a vibration region of the speaker unit 32*a*.

In the present embodiment having the above-described structure, the speaker units 32*a* are arranged such that the adhesion margins 3222 thereof overlap each other, as shown in (a) of FIG. 18. This makes the interval d between the vibration regions smaller than the interval d in the speaker device 3. In the present embodiment, therefore, the interval de can be easily set to a value that satisfies the formula (2), and a deterioration of sound quality due to a phase interference can easily be prevented.

Moreover, in the present embodiment, since there is the surround 322 between the diaphragms 323 of the respective speaker units 32*a*, the diaphragms 323 vibrate independently of each other. This can prevent an unnecessary resonance, which may otherwise be caused by mutual transmission of vibrations of the diaphragms 323. Thus, all the speaker units 32*a* can vibrate in the same phase.

In the above description, the speaker module 42 includes four speaker units 32*a*, but this is not limitative. For example, the speaker module 42 may include twenty speaker units 32*a* so that the speaker device 4 has one speaker module 42.

Moreover, in the above description, each speaker unit 32*a* has the surround 322, but this is not limitative. The surrounds 322 may be integrally formed with the adhesion margins 3222 thereof overlapping each other, and the integrally-formed one surround may be shared by the speaker units 32*a*.

Furthermore, in the above description, all of the speaker units 32*a* are arranged such that the adhesion margins 3222 thereof overlap each other. However, only two speaker units 32*a* may be arranged such that the adhesion margins 3222 thereof overlap each other. Moreover, all of the speaker units 32*a* may be arranged such that the adhesion margins 3222 thereof do not overlap each other. Even in this case, the speaker units 32*a* share the one frame 421. Therefore, the interval d between the vibration regions of the respective speaker units 32*a* can be reduced as compared with when each speaker unit 32*a* has a frame.

Furthermore, in the above description, the speaker device 4 includes a plurality of speaker modules 42, but the speaker device 4 may include a plurality of speaker modules 22 shown in FIG. 6. In such a case, by arranging each speaker module 22 so as to be inclined at approximately 6° with respect to an adjacent speaker module 22 when seen from the lateral side of the speaker device 4, the arrangement of the speaker units when seen from the lateral side of the speaker device 4 can be formed into a substantially arc shape as shown in FIG. 17.

Furthermore, in the above description, the cabinet 41 is provided as one of the components of the speaker device 4, but the cabinet 41 may be removed from the components of the speaker device 4. In such a case, the speaker device 4 is exactly the speaker module 42.

Furthermore, in the above description, it is assumed that the differential distance Q satisfies the condition of the formula (2). However, even when the formula (2) is not satisfied, a deterioration of sound quality due to a phase interference can be suppressed, by adhesion margins of adjacent surrounds overlapping each other, as compared with when adhesion margins of adjacent surrounds do not overlap each other

Embodiment 5

In the speaker device 3 according to Embodiment 3, as shown in (b) of FIG. 7, the plurality of speaker units 32 are arranged in an arc when seen from the lateral side of the speaker device 3. On the other hand, in Embodiment 5, a case will be described in which, when seen from a lateral side of a speaker device, an arrangement shape is a straight line similarly to in Embodiment 1, but nevertheless the same effects as when the arrangement shape is an arc similarly to in Embodiment 3 can be obtained.

Figure 19:
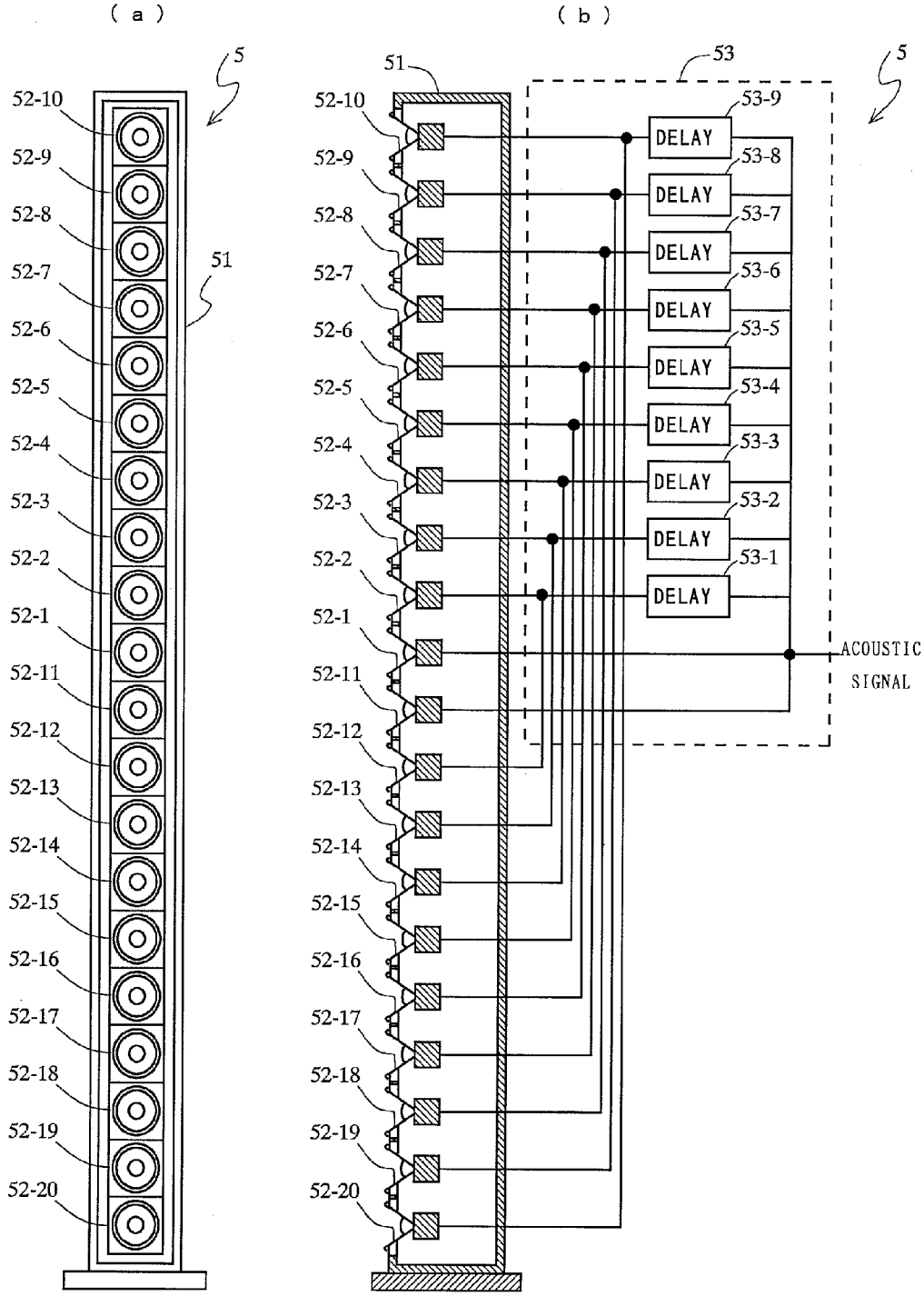
FIG. 19 is a diagram showing a structure of a speaker device according to Embodiment 5.

FIG. 19 is a diagram showing a structure of a speaker device according to Embodiment 5 of the present invention. In FIG. 19, (a) shows a front view of the speaker device, and (b) is a side view of the speaker device showing a cross-sectional structure thereof.

A speaker device 5 includes a cabinet 51, speaker units 52-1 to 52-20, and delay means 53, and is placed at home or the like where a listening position is at a short distance. In an example shown in FIG. 19, the speaker device 5 includes twenty speaker units, but this is not limitative. Each of the speaker units 52-1 to 52-20 is mounted in the cabinet 51 such that the front surface of the speaker unit faces the front side of the cabinet 51. As shown in (a) of FIG. 19, the speaker units 52-1 to 52-20 are arranged in a straight line, when seen from the front side of the speaker device 5, and the arrangement direction is parallel to the up-and-down direction of the speaker device 5. In addition, as shown in (b) of FIG. 19, the speaker units 52-1 to 52-20 are arranged in a straight line, when seen from the lateral side of the speaker device 5. Each of the speaker units 52-1 to 52-20 has the same structure section as that of an ordinary electrodynamic speaker. In (b) of FIG. 19, the structure section of each of the speaker units 52-1 to 52-20 is schematically shown. A manner of arrangement of the speaker units 52-1 to 52-20 is the same as in Embodiment 1, and therefore a description thereof is omitted here.

In the delay means 53, a delay time corresponding to each of the speaker units 52-1 to 52-20 is set. The delay means 53 delays an inputted acoustic signal by the set delay time, and outputs a delay signal which has been delayed, to a speaker unit corresponding to that delay time. The delay time is set to a time period in which the reproduced sound propagates from a position at which a corresponding speaker unit is arranged to a position at which the corresponding speaker unit is supposed to be arranged, assuming that the speaker units are arranged in an arc when seen from the lateral side of the speaker device.

Specifically, the delay means 53 include delay devices 53-1 to 53-9. In the delay devices 53-1 to 53-9, different delay times t1 to t9 are set, respectively. A specific method for setting the delay times t1 to t9 will be described later. The delay device 53-1 delays an inputted acoustic signal by the delay time t1, and outputs the resulting signal to the speaker units 52-2 and 52-12. The delay device 53-2 delays an inputted acoustic signal by the delay time t2, and outputs the resulting signal to the speaker units 52-3 and 52-13. Similarly, the delay devices 53-3 to 53-9 delay acoustic signals by the set delay times, respectively, and output the resulting signals to the speaker units 52-4 to 52-10 and 52-14 to 52-20, respectively. Since speaker units 52-1 and 52-11 are arranged approximately at the center of the arrangement, acoustic signals need not be delayed for the speaker units 52-1 and 52-11. Therefore, the delay time for the speaker units 52-1 and 52-11 is 0, and an acoustic signal is directly inputted to the speaker units 52-1 and 52-11.

Figure 20:
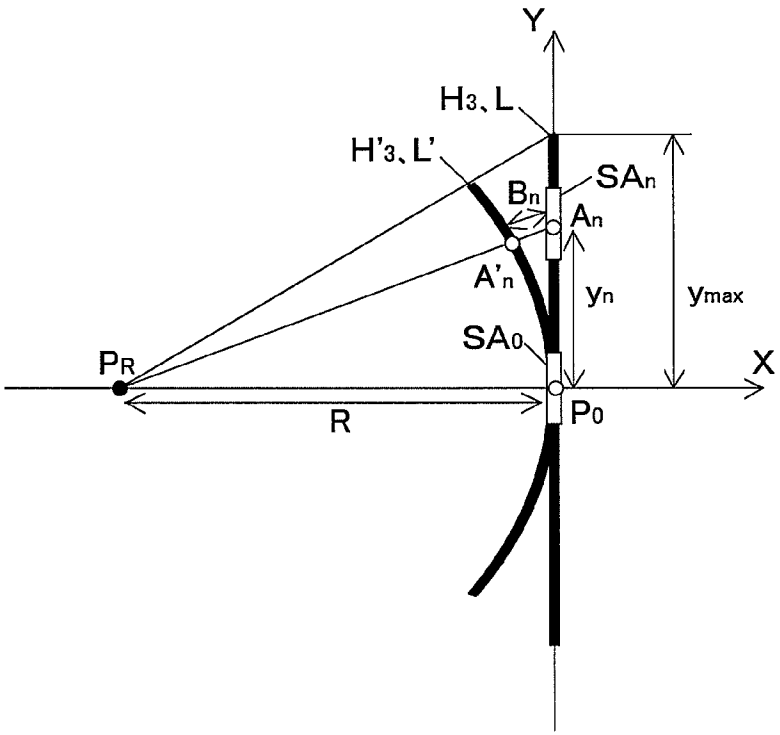
FIG. 20 is a diagram for illustrating a method for setting a delay time.

Hereinafter, a method for setting the delay time will be described. FIG. 20 is a diagram for illustrating a method for setting the delay time. In FIG. 20: the center $P_0$ of the arrangement of the speaker units 52 is defined as the origin on the Y-axis; the arrangement of the speaker units 52 is defined as $H_3$; and the arrangement length (the length of the straight line) of the speaker units 52 is defined as L. When assuming that the speaker units 52 are virtually arranged in an arc, the arrangement is defined as $H'_3$, and the arrangement length (the length of the arc) of the speaker units 52 is defined as L'. A point $P_R$ is the center of an arc of which the curvature radius is R, and located on the X-axis passing through the center $P_0$. In this condition, the arrangement length L and the arrangement length L' satisfy the relationship represented by the formula (5).

[Formula 5]

$$L=2R\cdot\tan(L'/2) \tag{5}$$

Accordingly, a distance $y_{max}$ from the upper end of the arrangement $H_3$ to the center $P_0$ is represented by the formula (6).

[Formula 6]

$$y\max=L/2=R\cdot\tan(L'/2) \tag{6}$$

An effective vibration region of the speaker unit 52-1 arranged approximately at the center $P_0$ is defined as $SA_0$. The n-th effective vibration region counted from the effective vibration region $SA_0$ toward the Y-axis positive direction is defined as SA. A distance from the center of the effective vibration region $SA_n$ to the center $P_0$ is defined as $y_n$, and the center of the effective vibration region $SA_n$ is defined as $A_n$. Here, an acoustic wave, which is emitted from the point $A'_n$ on the arrangement $H'_3$, travels in a direction perpendicular to a tangent to the arc, and reaches the point $A_n$ on the arrangement $H_3$. At this time, a distance $B_n$ between the point $A_n$ and the point $A'_n$ is represented by the formula (7).

[Formula 7]

$$B_n=\overrightarrow{\sqrt{R^2+y_n^2}-R} \tag{7}$$

Accordingly, the delay time $t_n$ required for causing the speaker device 5 to operate as if the effective vibration region $SA_n$ was arranged at the point $A'_n$ is represented by the formula (8). In the formula (8), c indicates an acoustic velocity.

[Formula 8]

$$t_n = \frac{B_n}{c} = \frac{\sqrt{R^2 + y_n^2} - R}{c} \tag{8}$$

By setting the delay times t1 to t9 based on the formula (8), the speaker units 52-1 to 52-20 operate as if the speaker units 52-1 to 52-20 were arranged in an arc such as the arrangement $H'_3$.

As described above, in the speaker device 5 according to Embodiment 5, the arrangement shape of the speaker units is a straight line when seen from the lateral side of the speaker device, but nevertheless the same operation as when the arrangement shape is an arc can be achieved, and thus the same effects as when the arrangement shape is an arc can be obtained.

Figure 21:
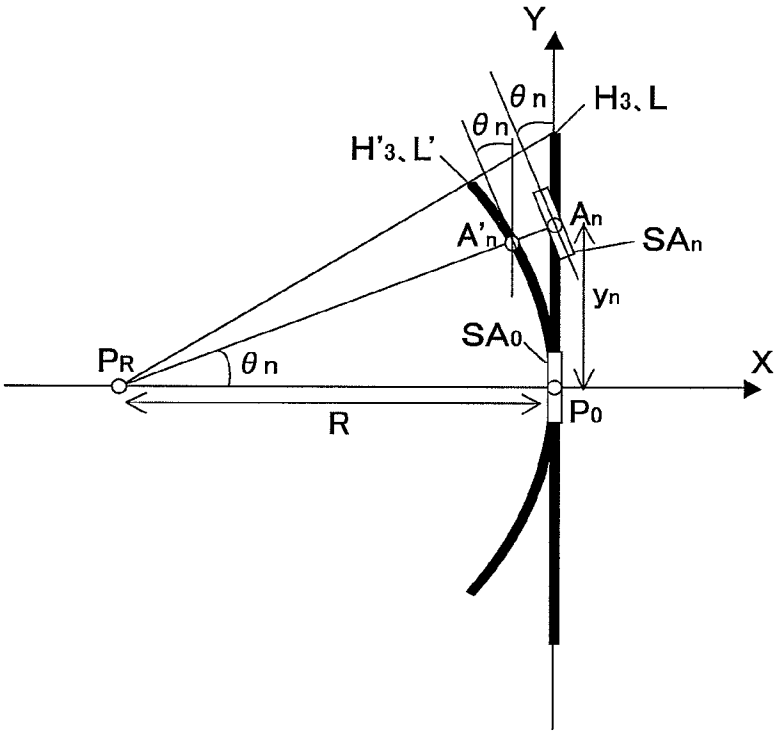
FIG. 21 is a diagram showing how an inclination of each of speaker units 52-1 to 52-20 is varied in accordance with an arc-shaped arrangement.

In the above description, acoustic signals inputted to the speaker units 52-1 to 52-20 are merely delayed, but this is not limitative. An inclination of each of the speaker units 52-1 to 52-20 may be varied in accordance with an arc-shaped arrangement. FIG. 21 is a diagram showing how an inclination of each of the speaker units 52-1 to 52-20 is varied in accordance with an arc-shaped arrangement. FIG. 21 shows an inclination of, instead of the speaker units 52-1 to 52-20, the effective vibration region $SA_n$. In FIG. 21, an inclination of the effective vibration region $SA_n$ relative to the Y-axis is defined as $\theta_n$. In this condition, the inclination $\theta_n$ is represented by the formula (9).

[Formula 9]

$$\tan\theta_n = \frac{y_n}{R} \tag{9}$$

By varying the inclinations of the speaker units 52-1 to 52-20 so as to satisfy the formula (9), improved emission characteristics can be obtained in the arrangement direction of the speaker units 52-1 to 52-20.

In the above, the case in which the delay devices 53-1 to 53-9 are applied to Embodiment 1 is described. However, the delay devices 53-1 to 53-9 may be applied to Embodiment 2.

In the above description, the delay means 53 is provided as a part of the components of the speaker device 5, but this is not limitative. The delay means 53 may be provided in an audio amplifier (not shown) which is connected to the speaker device 5. In addition, the delay means 53 may be configured as either an analog circuit or a digital circuit.

Embodiment 6

In the present embodiment, a case will be described in which the speaker device according to each of Embodiments 1 to 5 is installed in a video apparatus such as a flat-screen television.

Figure 22:
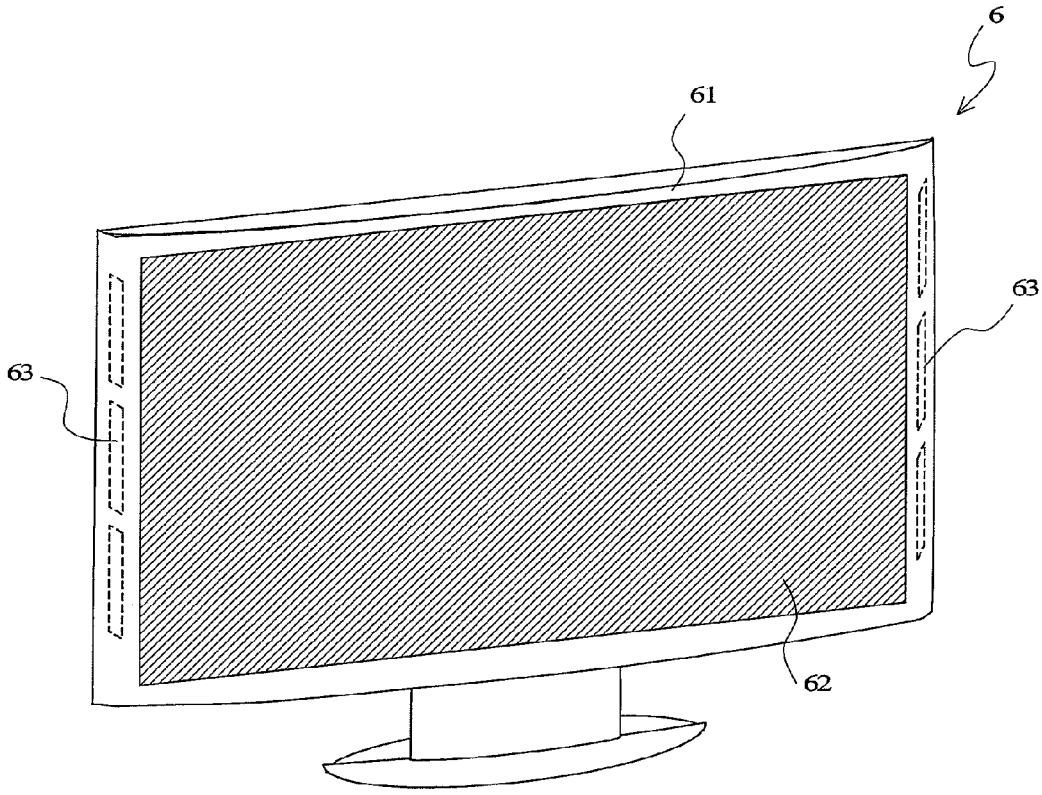
FIG. 22 is a front external view of a flat-screen television according to Embodiment 6.
Figure 2:
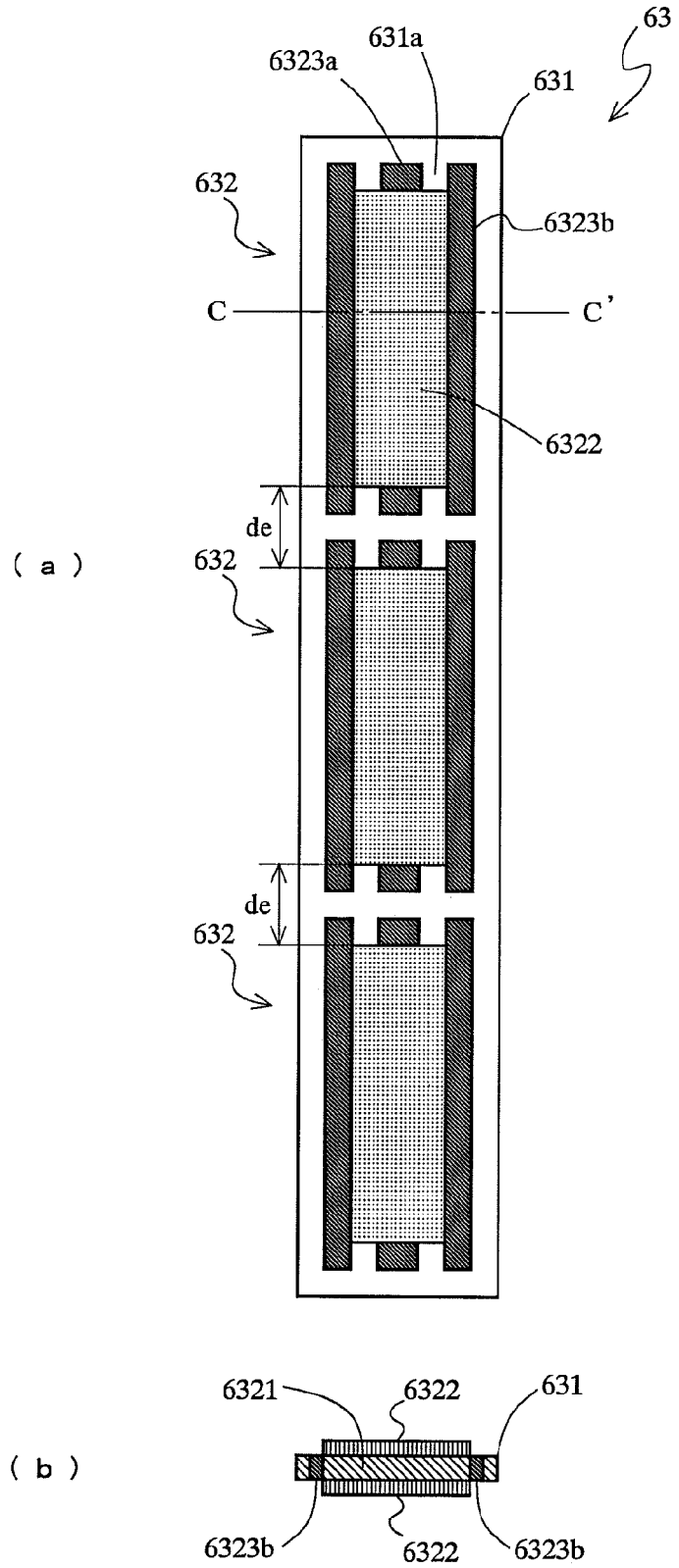
Figure 2:
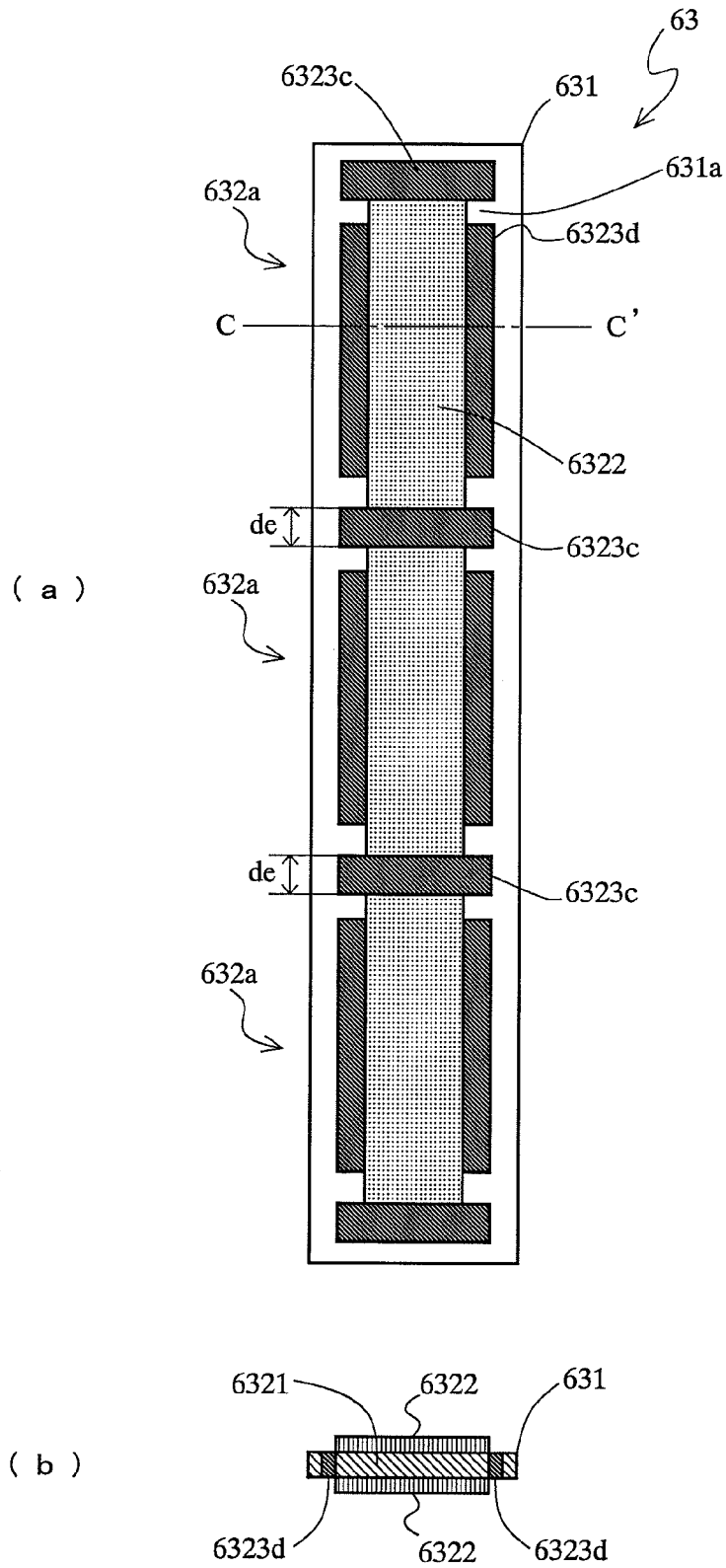
Figure 25:
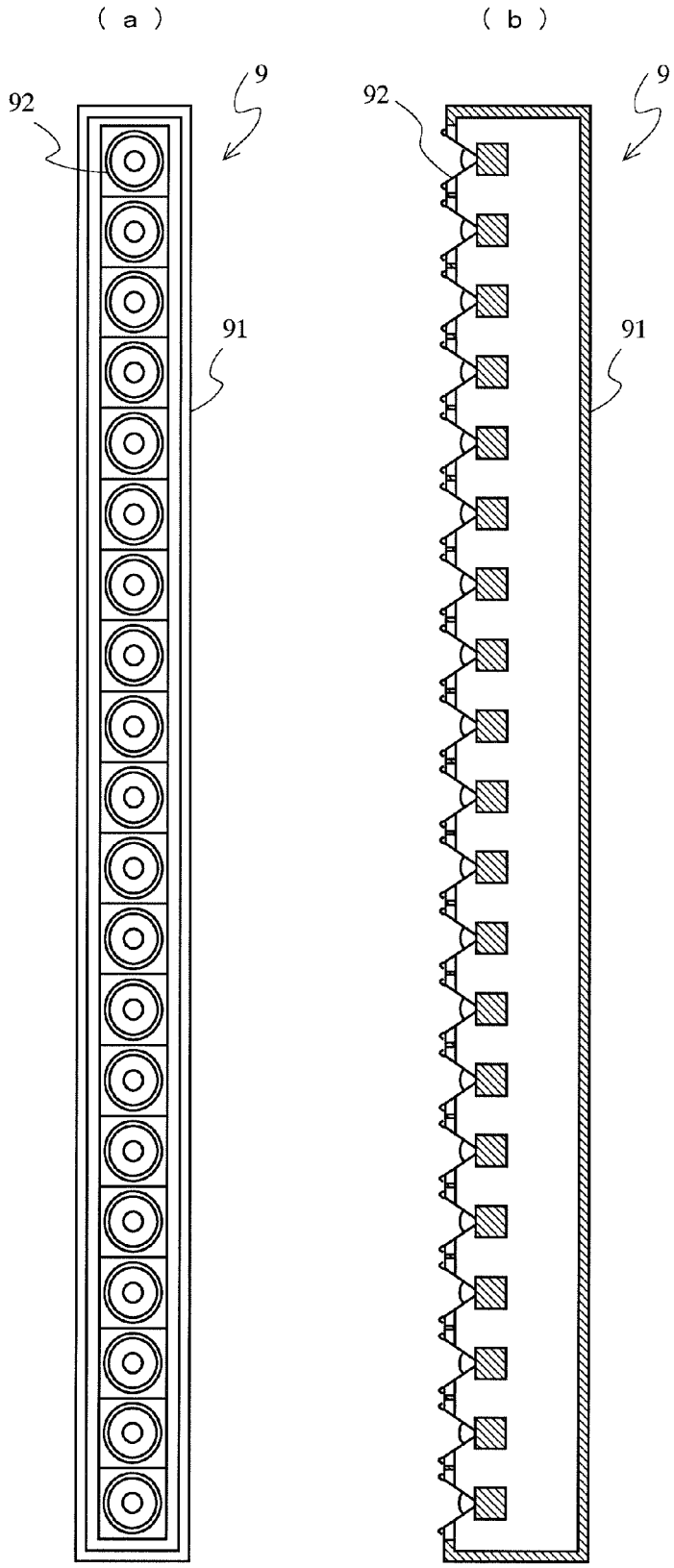
FIG. 25 PRIOR ART
FIG. 25 is a diagram showing a structure of a conventional speaker device.
Figure 2:
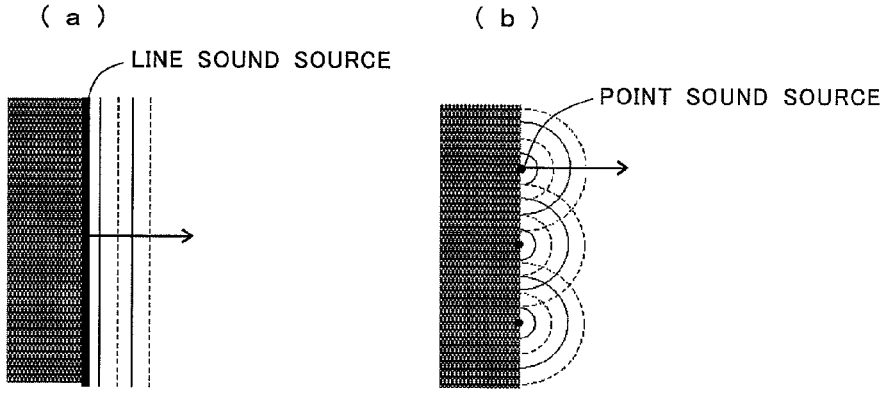
Figure 2:
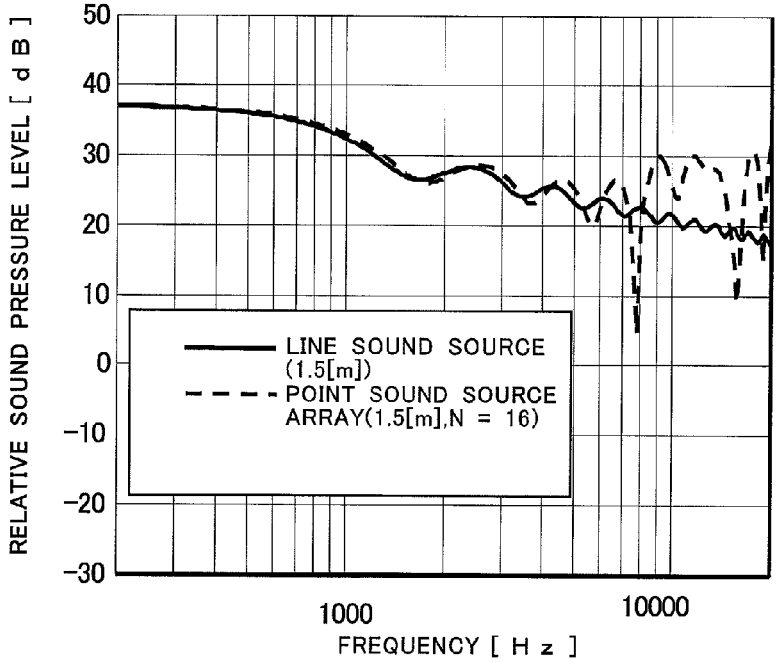

FIG. 22 is a front external view of a flat-screen television according to Embodiment 6. A flat-screen television 6 includes a housing 61, a display 62, and speaker devices 63. The housing 61 has such a shape that the thickness thereof in the anteroposterior direction gradually decreases from the center to the both lateral ends of the housing 61. The display 62 is mounted in a central portion of the housing 61, and the speaker devices 63 are mounted at the both lateral ends and inside the housing 61.

FIG. 23 is a diagram showing a structure of the speaker device 63. In FIG. 23, (a) shows a front view of the speaker device 63, and (b) shows a structure section of the speaker device 63, when cut along the line C-C'. As shown in FIG. 23, the speaker device 63 includes a frame 631 and a plurality of speaker units 632. The speaker unit 632 is a piezoelectric type speaker, and has a substrate 6321, piezoelectric elements 6322, and surrounds 6323*a* and 6323*b*. As shown in (b) of FIG. 23, the piezoelectric elements 6322 are provided on the upper and lower surfaces of the substrate 6321, respectively. As shown in (a) of FIG. 23, the surrounds 6323*a* are provided at the upper and lower ends of the substrate 6321 and the piezoelectric elements 6322, respectively, and the surrounds 6323*b* are provided at the left and right ends of the substrate 6321 and the piezoelectric elements 6322, respectively. As shown in (a) of FIG. 23, the piezoelectric element 6322 has a rectangular shape, and is connected to electrodes that are formed on a suspension portion 631*a* of the frame 631 and the frame 631. When an acoustic signal is inputted via the electrode, the piezoelectric element 6322 vibrates together with the substrate 6321, and converts the acoustic signal into an acoustic wave.

A shape of a vibration region of the speaker unit 632 corresponds to the shape of the piezoelectric elements 6322, that is, the rectangular shape. Accordingly, the vibration region of the speaker unit 632 exactly serves as an effective vibration region, and an interval between vibration regions of adjacent speaker units 632 serves as an interval de between the effective vibration regions. Here, it is assumed that the interval de is set such that the differential distance Q satisfies the condition of the formula (2).

In the speaker device 63 having the above-described structure, the plurality of speaker units 632 share the one frame 631. Therefore, the interval de between the effective vibration regions of adjacent speaker units 632 can be reduced as compared with when each of the plurality of speaker units 632 has a frame. Moreover, since the speaker unit 632 is a piezoelectric type speaker, the size of the entire speaker device 63 can be made small. Furthermore, in the speaker device 63, the frame 631, the substrate 6321, and the surrounds 6323*a* and 6323*b* can be integrally formed. Therefore, manufacturing costs can be reduced as compared with when a plurality of speaker units 632 are separately provided.

The structure of the speaker device 63 is not limited to the structure shown in FIG. 23, and may be a structure in which adjacent speaker units share an surround, as shown in FIG. 24. FIG. 24 is a diagram showing another structure of the speaker device 63. In FIG. 24, (a) shows a front view of the speaker device 63, and (b) shows a structure section of the speaker device 63, when cut along the line C-C'. As shown in FIG. 24, the speaker device 63 includes a frame 631 and a plurality of speaker units 632*a*. The speaker unit 632*a* is a piezoelectric type speaker, and has a substrate 6321, piezoelectric elements 6322, and surrounds 6323*c* and 6323*d*. As shown in (a) of FIG. 24, the surrounds 6323*c* are provided at the upper and lower ends of the substrate 6321 and the piezoelectric elements 6322, respectively, and the surrounds 6323*d* are provided at the left and right ends of the substrate 6321 and the piezoelectric elements 6322, respectively. The surround 6323*c* is shared between the adjacent speaker units 632*a*.

Here, an interval de between effective vibration regions of the speaker units 632*a* is the width of the surround 6323*c*. The structure shown in FIG. 24 enables an interval de between effective vibration regions of speaker units to be smaller than the interval de shown in FIG. 23.

INDUSTRIAL APPLICABILITY

The speaker device according to the present invention is capable of, when used in a place where a listening position is at a short distance, suppressing a deterioration of sound quality due to a phase interference. The speaker device according to the present invention is applied to, for example, a music reproduction system for a small sound field, such as a home-use audio system, a home theater system, and a public address system for a small hall.

The invention claimed is:

1. A speaker device comprising a plurality of speaker units arranged in a line when seen from a front side of the speaker device, wherein:

each of the speaker units includes a diaphragm and a surround attached to an outer circumference of the diaphragm; and two of the speaker units are arranged such that the surrounds of the two speaker units partly overlap each other.

2. The speaker device according to claim 1, wherein:

at least one of intervals between effective vibration regions of adjacent speaker units is set to a predetermined length; and the predetermined length is a length that is set such that a difference between a distance from an end of one of the effective vibration regions, which form the at least one of intervals therebetween, to a listening position, and a distance from an end of another of the effective vibration regions to the listening position can be less than half of a shortest wavelength of a reproduced sound of each of the speaker units.

3. The speaker device according to claim 1, wherein the speaker units are arranged in an arc when seen from a lateral side of the speaker device.

4. The speaker device according to claim 2, wherein:

the speaker units are arranged in an arc when seen from a lateral side of the speaker device; and a relationship of $(R+D)\times(L/R)\geqq D$ is satisfied, where: an arrangement length of the speaker units is defined as L; a curvature radius of the arc is defined as R; and a listening distance from a center of the arrangement of the speaker units to the listening position is defined as D.

5. The speaker device according to claim 2, wherein:

the speaker units are arranged in an arc when seen from a lateral side of the speaker device; and when a listening distance from a center of the arrangement of the speaker units to the listening position is equal to or less than 5 m, a relationship of $(L/R)\geqq 1.5$ is satisfied, where: an arrangement length of the speaker units is defined as L; and a curvature radius of the arc is defined as R.

6. The speaker device according to claim 2, wherein:

the speaker units are arranged in an arc when seen from a lateral side of the speaker device; and when a listening distance from a center of the arrangement of the speaker units to the listening position is 3 m, a relationship of $(L/R)\geqq 0.5$ is satisfied, where: an arrangement length of the speaker units is defined as L; and a curvature radius of the arc is defined as R.

7. The speaker device according to claim 1, wherein the speaker units are arranged in a straight line when seen from a lateral side of the speaker device.

8. The speaker device according to claim 7, further comprising delay means for delaying an inputted acoustic signal by a delay time which is set so as to correspond to each of the speaker units, and outputting the delayed acoustic signal to a corresponding speaker unit, wherein the delay time is set to a time period in which a reproduced sound propagates from a position at which a corresponding speaker unit is arranged to a position at which the corresponding speaker unit is supposed to be arranged, assuming that the speaker units are arranged in an arc when seen from the lateral side of the speaker device.

9. The speaker device according to claim 8, wherein each of the speaker units is inclined relative to an arrangement direction which is along a straight line when seen from the lateral side of the speaker device, at an angle corresponding to a position at which each speaker unit is supposed to be arranged, assuming that the speaker units are arranged in the arc when seen from the lateral side of the speaker device.

10. The speaker device according to claim 1, further comprising a cabinet in which the speaker units are mounted.

11. The speaker device according to claim 1, further comprising one frame to which the speaker units are mounted, wherein the surround of each speaker unit supports the diaphragm on the frame such that the diaphragm is vibratable.

12. The speaker device according to claim 11, wherein:

the surround of each speaker unit includes a round portion and an adhesion margin; and the adhesion margins of the two speaker units partly overlap each other.

13. The speaker device according to claim 1, wherein the two speaker units share the surround integrally formed.

14. The speaker device according to claim 1, wherein an effective vibration region of each of the speaker units has an area of $4\pi$ [$cm^2$] or larger.

15. The speaker device according to claim 1, wherein a drive system of each of the speaker units is of any one of an electrodynamic type, a piezoelectric type, an electrostatic type, and an electromagnetic type.

16. The speaker device according to claim 1, wherein the diaphragm of each of the speaker units has any one of a circular shape, an oval shape, and a rectangular shape.

17. A video apparatus comprising:

a speaker device according to claim 1; and a housing having the speaker device disposed therein.

* * * * *